US006846065B2

(12) United States Patent
Otsuki

(10) Patent No.: US 6,846,065 B2
(45) Date of Patent: Jan. 25, 2005

(54) BIDIRECTIONAL PRINTING USING TWO NOZZLE GROUP SETS ARRANGED IN REVERSE ORDER

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 35 days.

(21) Appl. No.: 10/609,669

(22) Filed: Jul. 1, 2003

(65) Prior Publication Data

US 2004/0207685 A1 Oct. 21, 2004

(30) Foreign Application Priority Data

Jul. 4, 2002 (JP) ..... 2002-195422

(51) Int. Cl.[7] ..... B41J 2/145; B41J 2/15
(52) U.S. Cl. ..... 347/40
(58) Field of Search ..... 347/40, 9, 12, 347/16, 43, 15

(56) References Cited

U.S. PATENT DOCUMENTS 4,593,295 A * 6/1986 Matsufuji et al. ..... 347/41
2002/0070999 A1 * 6/2002 Teshigawara et al. ..... 347/41

FOREIGN PATENT DOCUMENTS

EP 955174 A2 * 11/1999 ..... B41J/19/14
JP 8-295034 A 11/1996

* cited by examiner

*Primary Examiner*—Thinh Nguyen
(74) *Attorney, Agent, or Firm*—Sughrue Mion, PLLC

(57) ABSTRACT

A technology that reduces color unevenness due to conspicuous areas for which ink is discharged in different ink discharge sequences is provided. First and second nozzle group sets each discharges multiple ink colors including black ink are used, wherein the ink discharge sequence followed by the first nozzle group set for a given pixel during one pass of forward path main scanning is the opposite of the ink discharge sequence followed by the second nozzle group set for a given pixel during the same pass of forward path main scanning, and bidirectional printing is carried out using both the first and second nozzle group sets during both forward path main scanning and reverse path main scanning.

25 Claims, 16 Drawing Sheets

BIDIRECTIONAL PRINTING USING TWO NOZZLE GROUP SETS ARRANGED IN REVERSE ORDER

BACKGROUND OF THE INVENTION

1. Field of the Invention

The present invention relates to a printing technology for printing images by discharging ink onto a printing medium.

2. Description of the Related Art

In recent years, printing apparatuses (hereinafter 'inkjet printers') that print images by forming ink dots on a printing medium through the discharge of ink droplets have become widely used as image output apparatuses. Multiple nozzle groups that discharge various colors of ink are disposed on the print head of such an inkjet printer, and images are printed through the discharge of ink from each nozzle onto a printing medium.

There is a demand for faster printing capability to accommodate large volume jobs, and printing media of larger formats. In order to respond to this demand, bidirectional printing, in which ink dots are formed during both the forward and reverse paths of the print head's movement over the print medium during main scanning, has been developed and is currently available.

When bidirectional printing is executed, the order of ink drop discharge from the print head with respect to a given pixel is different during forward path main scanning and reverse path main scanning. For example, let us consider a situation in which a print head is used containing four nozzle groups that discharge ink in the four colors of black (K), cyan (C), magenta m and yellow (Y) and are aligned in the order of KCMY as viewed in the direction of the forward path of main scanning. During forward path main scanning, with respect to a given pixel, ink is discharged in the order of YMCK. During reverse path main scanning, ink is discharged in the reverse order of KCMY with respect to a given pixel. If the order of ink discharge is different for the different colors of ink, the order in which the different colors of ink permeate the print medium also changes. Therefore, even if the same amount of ink is discharged for each color, the resulting hue will be slightly different for each pixel. As a result, even if the same amount of ink is discharged, the dots formed during forward path main scanning will have a different hue than dots formed during reverse path main scanning. When bidirectional printing is executed, the regions in which the order of ink discharge is different become conspicuous and color unevenness is perceived.

SUMMARY OF THE INVENTION

Accordingly, an object of the present invention is to provide a technology that prevents color unevenness caused by variations in hue between pixels formed during forward path main scanning and pixels formed during reverse path main scanning, thereby improving image quality.

In order to resolve at least a part of the problem described above, there is provided a printing apparatus that comprises a print head having multiple nozzle groups each composed of multiple nozzles that discharge same color of ink, and that prints images by carrying out main scanning in which the print head is moved relative to the print medium and sub-scanning in which the print head is moved relative to the print medium in a direction perpendicular to the direction of the main scanning. The print head includes first and second nozzle group sets each includes multiple nozzle groups that discharge multiple colors of ink including black ink, the multiple nozzle groups in the first nozzle group set are arranged in a first sequence along the direction of main scanning, and at least some of the multiple nozzles comprising each nozzle group are disposed at identical positions in the sub-scanning direction. The multiple nozzle groups in the second nozzle group set are arranged in a second sequence along the direction of main scanning that is the reverse of the first sequence, and at least some of the multiple nozzles comprising each nozzle group are disposed at identical positions in the sub-scanning direction. The printing apparatus can execute a first type of bidirectional printing in which the nozzle groups in the first nozzle group set and the second nozzle group set are used during both forward path and reverse path main scanning.

According to this printing apparatus, the order of ink discharge for the various ink colors is reversed with regard to the pixels recorded during one main scanning pass conducted by the first nozzle group set and the pixels recorded during this main scanning pass conducted by the second nozzle group set. By appropriately aggregating the pixels recorded by these two nozzle group sets, bidirectional printing with no color unevenness can be executed. Furthermore, by printing using two different nozzle group sets for forward path and reverse path movement during bidirectional main scanning, faster printing can be achieved.

This invention can be realized in various forms. For example, the invention may be realized as a printing method and a printing apparatus, a print control method and a print control apparatus, a computer program for implementing the functions of these methods and apparatuses, a recording medium on which this computer program is recorded, and data signals that include this computer program and are embodied within a carrier wave.

These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will be described below based on examples thereof according to the following sequence:

A. Construction of apparatus
B. First embodiment
C. Second embodiment
D. Third embodiment
E. Fourth embodiment
F. Fifth embodiment
G. Sixth embodiment
H. Variation

A. Construction of Apparatus

Figure 1:
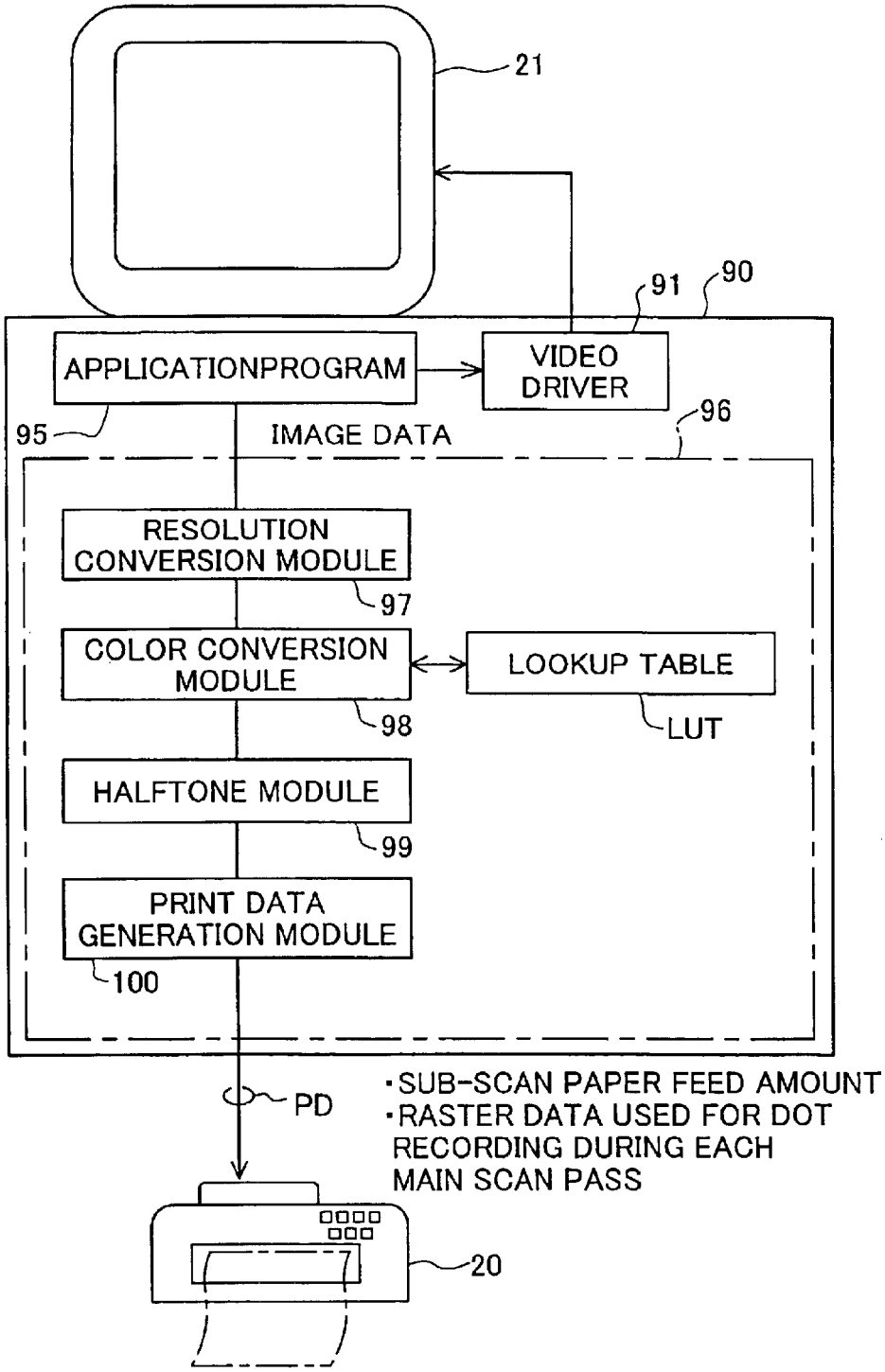
FIG. 1 is an explanatory drawing showing the construction of a print system constituting an embodiment of the present invention.

FIG. 1 is a block diagram showing the construction of a print system constituting an embodiment of the present invention. This print system includes a computer 90 that functions as a print control apparatus and a printer 20 that functions as a printing unit. The combination of the computer 90 and the printer 20 can be referred to in a general sense as a 'printing apparatus'.

An application program 95 runs on the computer 95 under a prescribed operating system. A video driver 91 and printer driver 96 are incorporated in the operating system, and print data PD is supplied from the application program 95 via these drivers for forwarding to the printer 20. The application program 95 executes desired processing of images to be processed and displays the images on the CRT 21 via the video driver 91.

When a print command is issued by the application program 95, the printer driver 96 of the computer 90 receives image data from the application program 95 and converts this image data into print data PD to be supplied to the printer 20. In the example shown in FIG. 1, the printer driver 96 contains a resolution conversion module 97, a color conversion module 98, a halftone module 99, a print data generation module 100 and a lookup table LUT. The printer driver 96 functions as a print data generation section.

The resolution conversion module 97 converts the resolution of the color image data handled by the application program 95 (i.e., the number of pixels per unit length) into a resolution that can be handled by the printer driver 96. The image data that has undergone this resolution conversion still comprises RGB colors. The color conversion module 98 converts the RGB image data (first image data) for each pixel into multiple-tone data comprising multiple colors (second image data) that can be used by the printer 20, with reference to the lookup table LUT.

The color-converted multiple-tone image data has a gradation of 256 tones, for example. The halftone module 99 executes halftone processing in order to express this gradation via the printer 20 forming ink dots in a dispersed fashion. The halftone-processed image data is rearranged by the print data generation module 100 to create a data sequence to be forwarded to the printer 20, and is output as final print data PD. The print data PD includes raster data that indicates the recording status of each dot during each main scanning pass and data that indicates feed amounts of the printing medium during sub-scanning passes.

The printer driver 96 is equivalent to a program that realizes the function of generating the print data PD. The program that realizes the functions of the printer driver 96 is supplied in the form as a program recorded on a computer-readable printing medium. This printing medium may constitute any type of computer-readable medium, such as a flexible disk, CD-ROM, opto-magnetic disk, IC card, ROM cartridge or punch card, a printed matter on which a bar code or other symbol is imprinted, an internal storage device installed in the computer (a memory such as a RAM or a ROM), or an external storage device.

Figure 2:
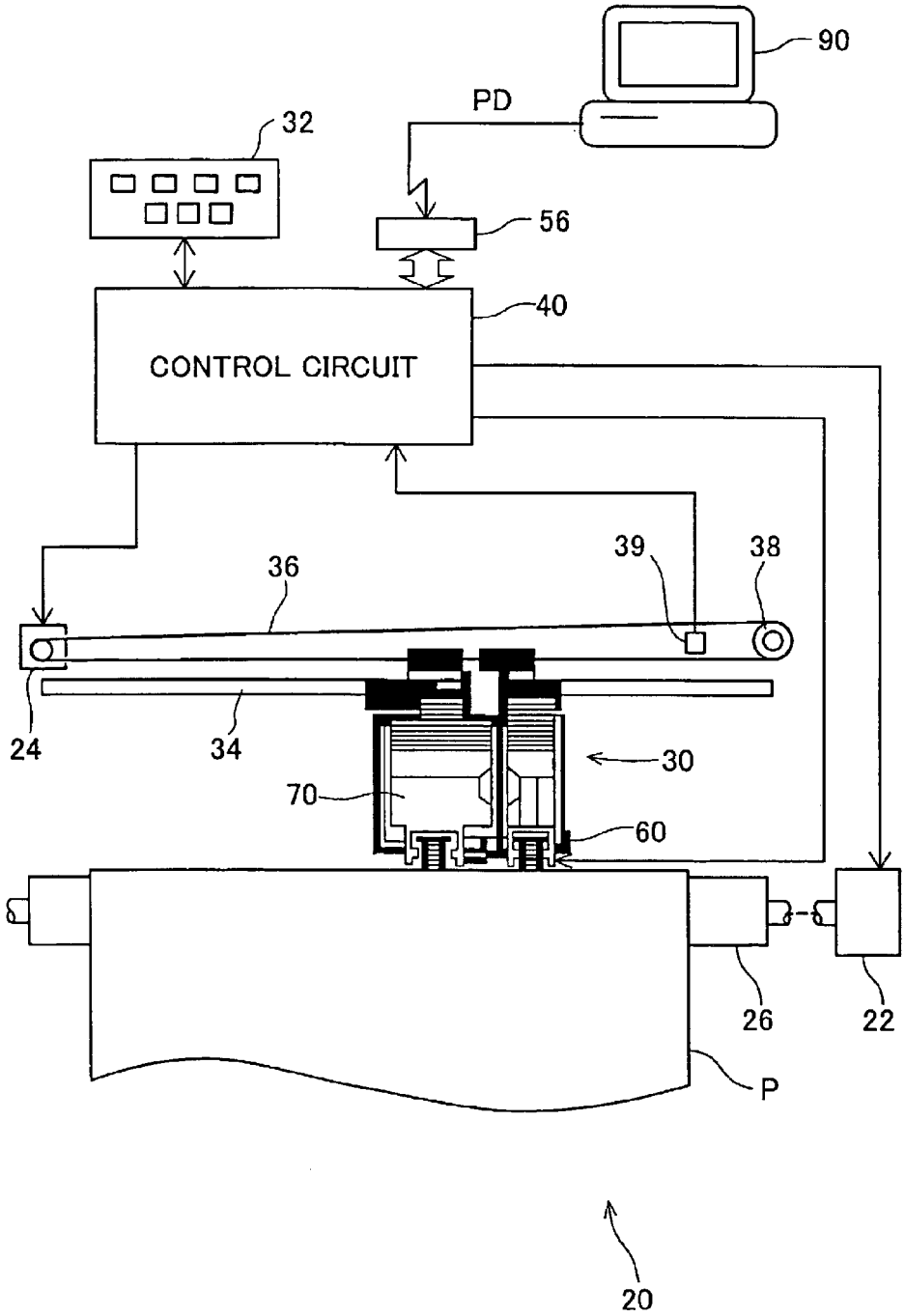
FIG. 2 is an explanatory drawing showing the construction of a printer.

FIG. 2 shows the basic construction of the printer 20. The printer 20 includes a sub-scanning feed mechanism that feeds the printing paper P in the sub-scanning direction via a paper feed motor 22, a main scanning feed mechanism that moves the carriage 30 back and forth in the axial direction of a platen 26 (the main scanning direction) via a carriage motor 24, a head drive mechanism that drives a print head unit 60 (also termed a 'print head assembly') mounted to the carriage 30 and controls ink discharge and dot formation, and a control circuit 40 that controls the transmission of signals to the paper feed motor 22, the carriage motor 24, the print head unit 60 and the operation panel 32. The control circuit 40 is connected to the computer 90 via a connector 56.

The sub-scanning feed mechanism that feeds the printing paper P includes a gear train (not shown) that transmits the rotation of the paper feed motor 22 to the platen 26 and to a paper feed roller (not shown). The main scanning feed mechanism that moves the carriage 30 back and forth includes a support shaft 34 that is disposed parallel to the platen 26 and slidably holds the carriage 30, a pulley 38 over which a continuous drive belt 36 is suspended such that the drive belt 36 is suspended between the pulley 38 and the carriage motor 24, and a position sensor 39 that detects the original position of the carriage 30.

Figure 3:
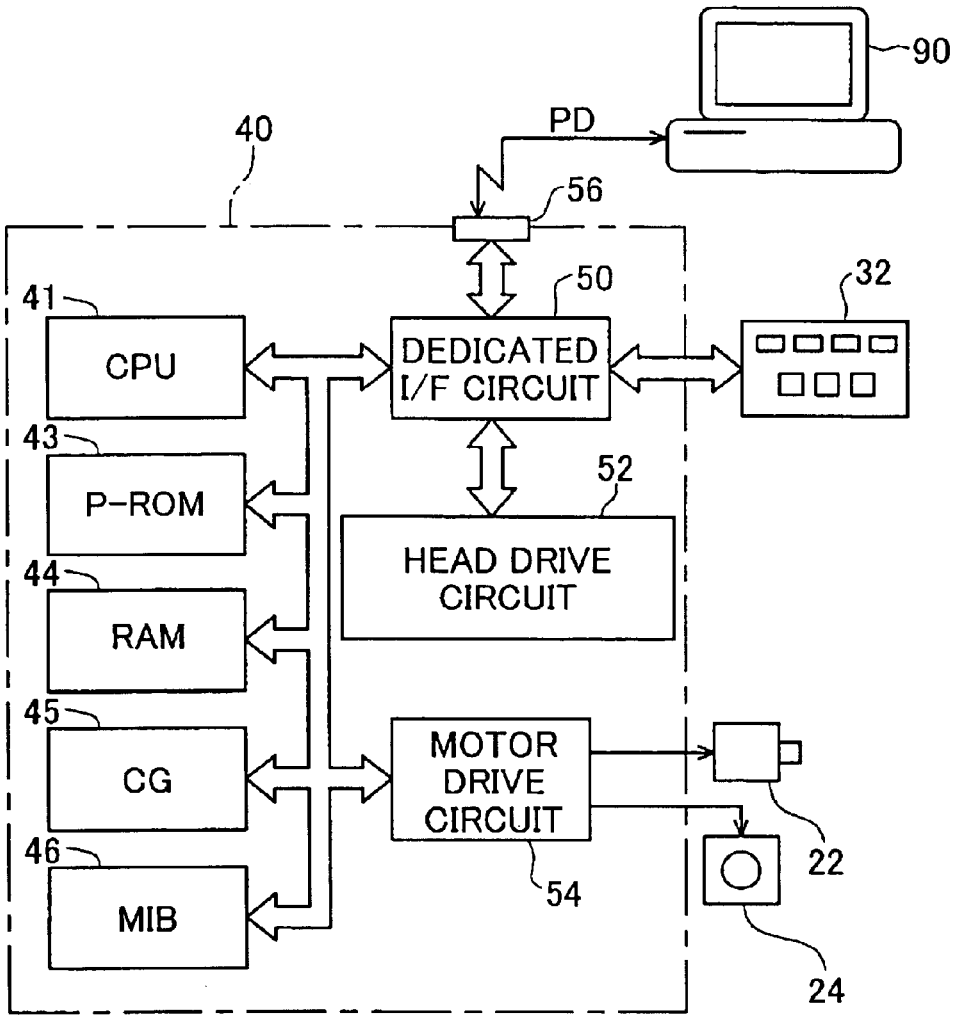
FIG. 3 is an explanatory drawing showing the construction of the control circuit 40 of a printer 20.

FIG. 3 is a block diagram showing the construction of the printer 20 with a focus on the control circuit 40. The control circuit 40 constitutes an arithmetic-logic circuit that includes a CPU 41, a programmable ROM (PROM) 43, a RAM 44 and a character generator (CG) 45 that stores a character dot matrix. The control circuit 40 furthermore includes a dedicated I/F circuit 50 that exclusively handles interfaces with external motors and the like, a head drive circuit 52 that is connected to the dedicated I/F circuit 50 and drives the print head unit 60 to discharge ink, and a motor drive circuit 54 that drives the paper feed motor 22 and the carriage motor 24.

Incorporated in the dedicated I/F circuit 50 is a parallel interface circuit, so that the print data PD supplied from the computer 90 may be received via the connector 56. The printer 20 executes printing in accordance with this print data PD. The RAM 44 functions as a buffer memory for temporary storage of raster data.

Figure 4:
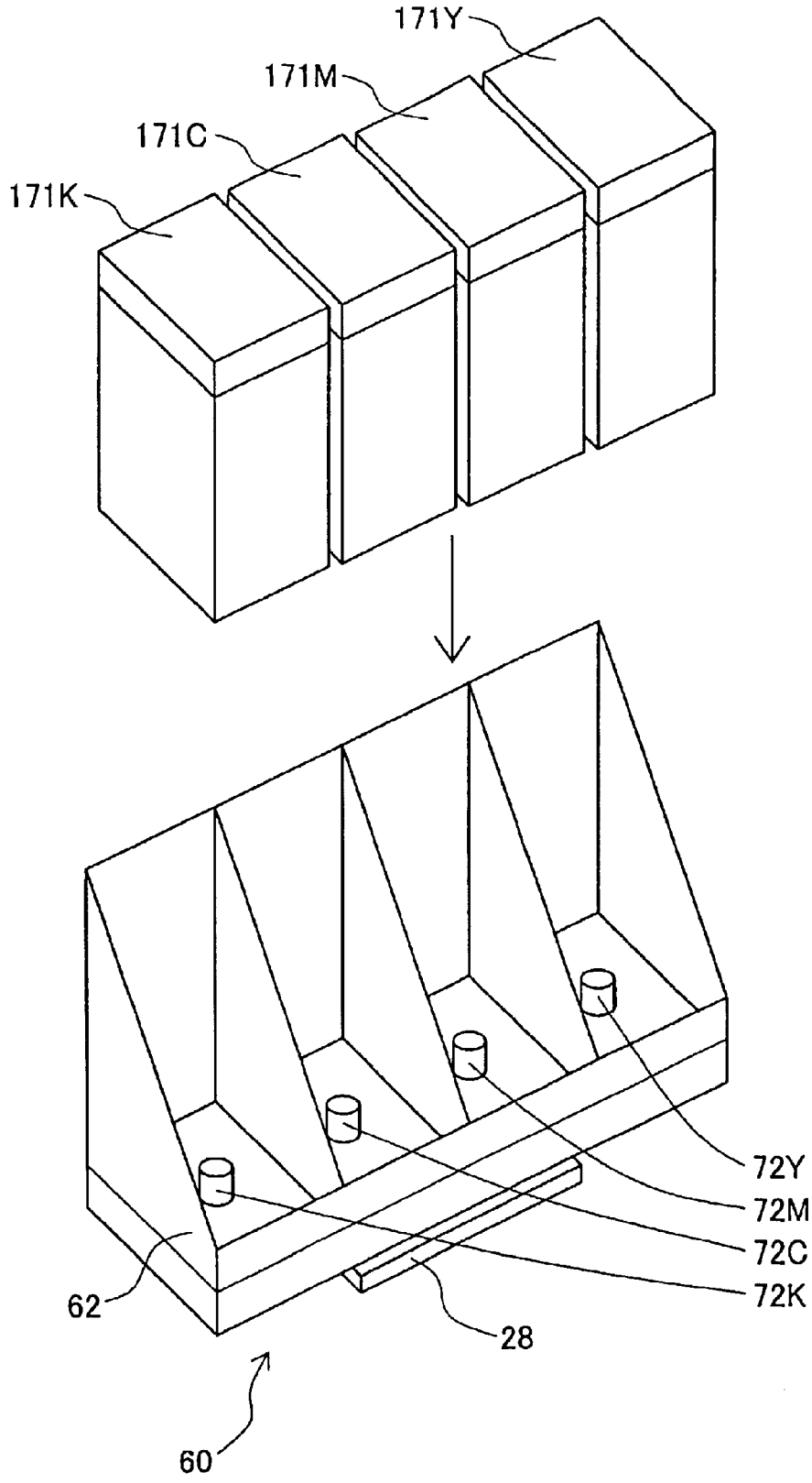
FIG. 4 is a perspective view of a print head unit 60.

FIG. 4 is a perspective view of the print head unit 60. The print head unit 60 includes an ink cartridge mounting section 62 and a print head 28. A black ink cartridge 171K that houses black ink, a magenta ink cartridge 171M that houses magenta ink, a cyan ink cartridge 171C that houses cyan ink and a yellow ink cartridge 171Y that houses yellow ink can be mounted to the ink cartridge mounting section 62. In this example, the four basic colors of ink, i.e., cyan ink C, magenta ink M, yellow ink Y and black ink K can be used, enabling color or monochrome printing to be executed.

Four introduction tubes 72K, 72C, 72M and 72K that are inserted in the respective ink cartridges in order to form ink flow channels are placed in the ink cartridge mounting section 62. These introduction tubes are connected to the various nozzle groups formed on the print head 28 mounted to the bottom of the print head unit 60. The print head 28 is described later in detail.

The printer 20 having the hardware construction described above feeds the printing paper P via the paper feed motor 22, and moves the carriage 30 back and forth via the carriage motor 24 while driving the print head 28 so that ink droplets of each color are discharged to form ink dots, thereby forming multi-color, multiple-tone images on the printing paper P.

B. First Embodiment

Figure 5:
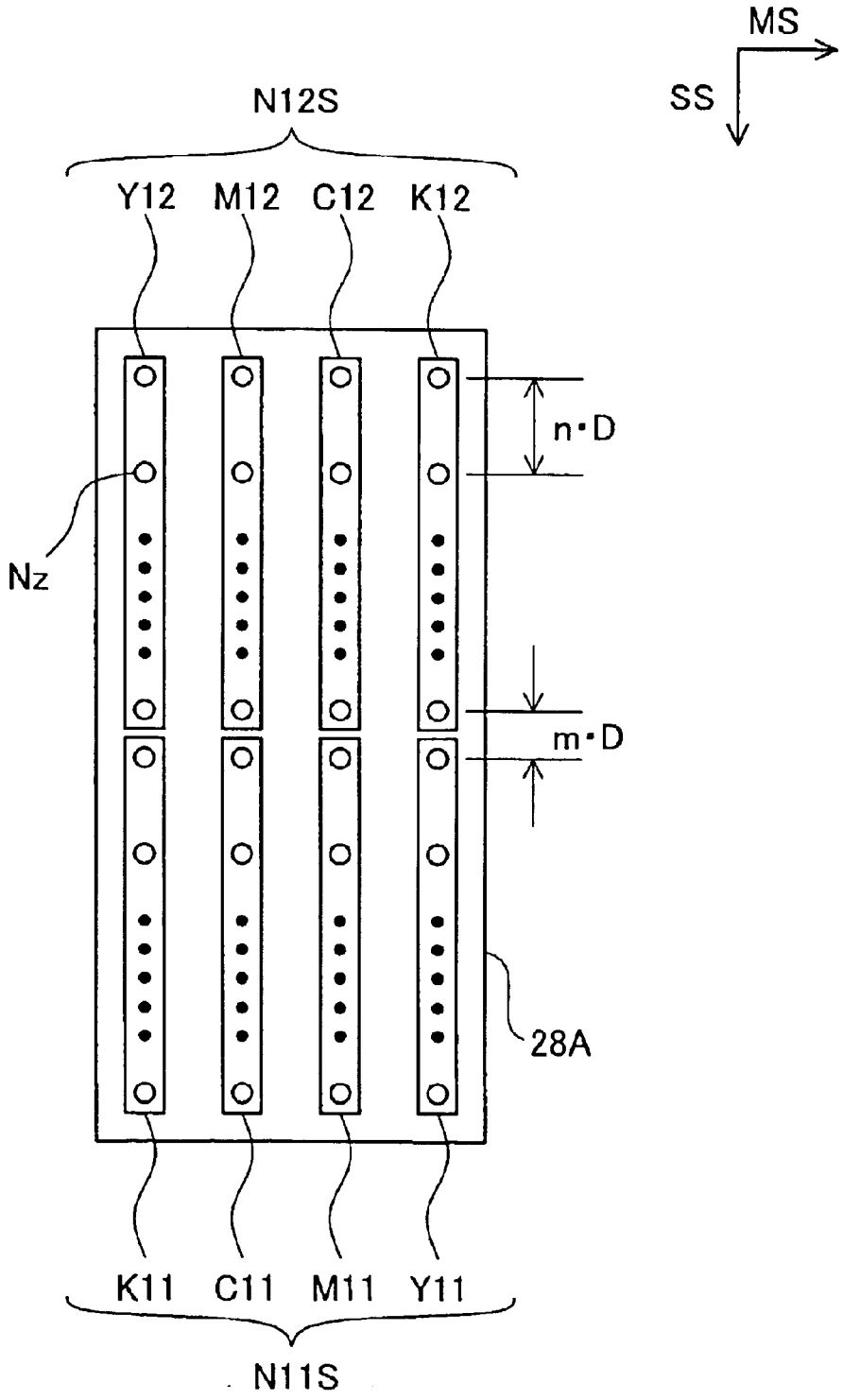
FIG. 5 is an explanatory drawing showing the nozzle arrangement on the bottom of a print head 28A of a first embodiment.

FIG. 5 is an explanatory drawing showing the nozzle arrangement on the bottom of a print head 28A of a first embodiment. Disposed on the bottom of the print head 28A are a first nozzle group set N11S comprising four nozzle groups K11, C11, M11 and Y11, as well as a second nozzle group set N12S comprising four nozzle groups K12, C12, M12 and Y12. The nozzle groups K11 and K12 discharge black ink K, the nozzle groups M11 and M12 discharge magenta ink M, the nozzle groups C11 and C12 discharge cyan ink C, and the nozzle groups Y11 and Y12 discharge yellow ink Y.

The nozzles $N_Z$ in each nozzle group are arranged such that the nozzle pitch along the sub-scanning direction is equal to n·D where n is a positive integer, and D is a dot pitch corresponding to the print resolution in the sub-scanning direction. The four nozzle groups comprising the first nozzle group set N11S are arranged in the sequence of K11, C11, M11, Y11 (the first sequence) in the forward path direction of main scanning, and are arranged such that the nozzles $N_Z$ in these nozzle groups are disposed at identical positions in the sub-scanning direction. The four nozzle groups comprising the second nozzle group set N12S are also arranged such that the nozzles $N_Z$ in these nozzle groups are disposed at identical positions in the sub-scanning direction. However, the sequence of Y12, M12, C12, K12 (the second sequence) in which the nozzle groups of the second nozzle group set N12S are arranged is the opposite of the sequence of arrangement of the nozzle groups in the first nozzle group set N11S (the first sequence). The first nozzle group set N11S and the second nozzle group set N12S are offset from each other in the sub-scanning direction such that they are not aligned in the main scanning direction. The minimum gap between the nozzles of the first nozzle group set N11S and the nozzles of the second nozzle group set N12S is m·D where m is a positive integer.

The discharge sequence for the various ink colors for the pixels to be recorded by the first nozzle group set N11S during one main scanning pass (forward path main scanning) is YMCK, while the discharge sequence for the various ink colors for the pixels to be recorded by the second nozzle group set N12S during the same main scanning pass is the reverse, i.e., KCMY. During reverse path main scanning, the discharge sequences are reversed for the two nozzle group sets. In the example shown in FIG. 5, the multiple nozzles $N_Z$ in one nozzle group are aligned in a straight line along the sub-scanning direction SS, but they may be arranged in a zigzag fashion instead.

Figure 6:
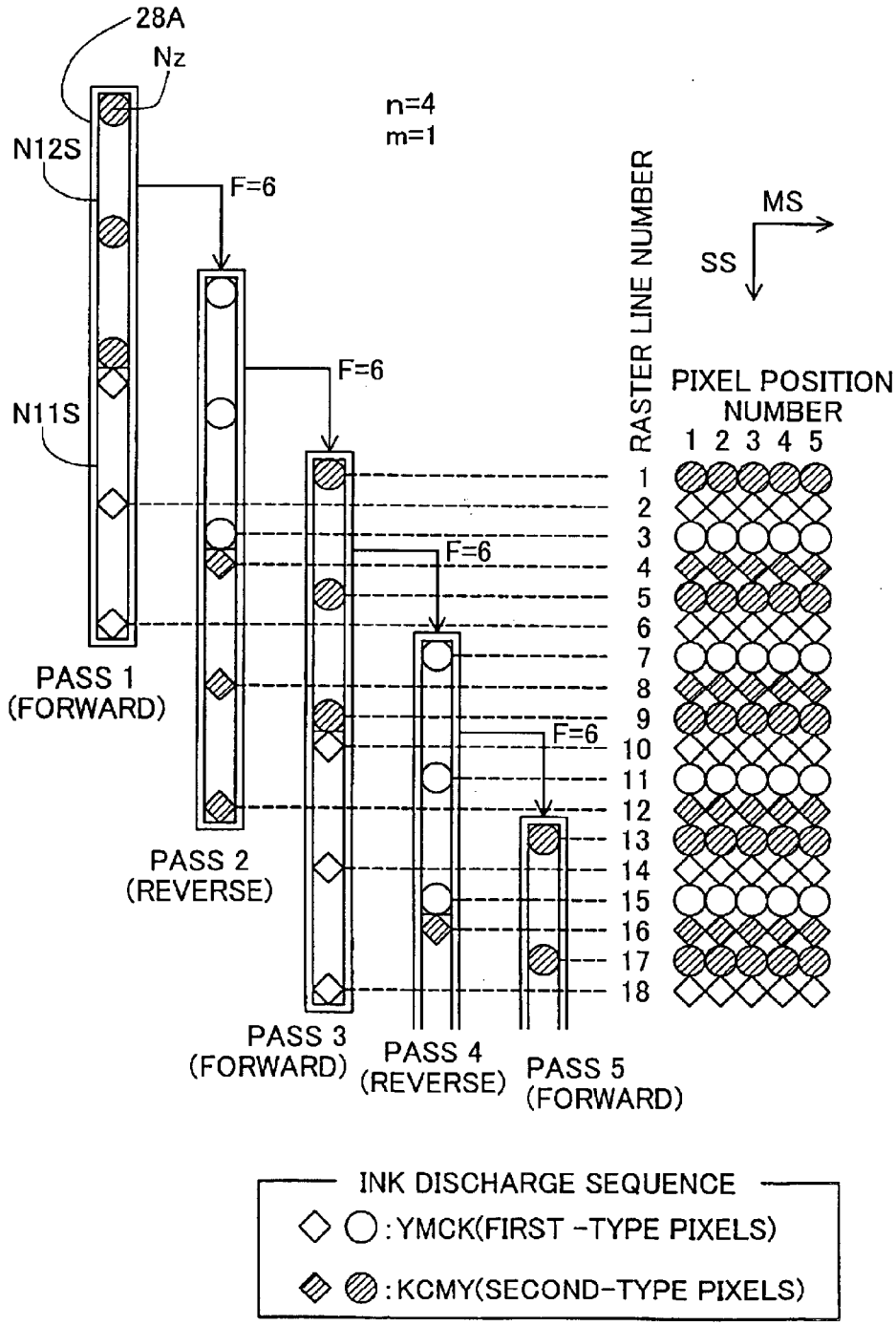
FIG. 6 is an explanatory drawing that describes an example of bidirectional printing.

FIG. 6 is an explanatory drawing that describes an example of bidirectional printing using the print head 28A of the first embodiment. In FIG. 6, it will be assumed that the values of n and m for the print head 28A shown in FIG. 5 are '4' and '1', respectively, and that each nozzle group has three nozzles.

The positions of the print head 28A in the sub-scanning direction during main scanning passes are shown at the left side of FIG. 6. The word 'Pass' written underneath the print head 28A refers to the ordinal number of the indicated main scanning pass. For example, 'Pass 2' means the second main scanning pass, and the print head 28A shown above 'Pass 2' is shown in its position in the sub-scanning direction during the second main scanning pass. In FIG. 6, for purposes of convenience, the multiple nozzle groups comprising each nozzle group set are represented by a single row of three nozzles $N_Z$. In addition, the nozzles of the first nozzle group set are represented by diamond marks, while the nozzles of the second nozzle group set are represented by circle marks. The marks for nozzles for which the inks are discharged in the YMCK sequence as to a given pixel (the first discharge sequence) are indicated as blank marks, while the marks for nozzles for which the inks are discharged in the KCMY sequence as to a given pixel (the second discharge sequence) are indicated as shaded marks. In the example shown in FIG. 6, during forward pass scanning (Pass 1, Pass 3, Pass 5, etc.) the ink discharge sequence for the first nozzle group set is YMCK, while the ink discharge sequence for the second nozzle group set is KCMY. The discharge sequences are reversed for the two nozzle group sets during reverse path main scanning.

The letter 'F' next to the arrows connecting two adjacent print heads in FIG. 6 (such as the print heads indicated by 'Pass 2' and 'Pass 3') indicates the paper feed amount for sub-scanning carried out between two main scanning passes, and the units for such paper feed amount are dots (using the dot pitch corresponding to the print resolution in the sub-scanning direction). In the example shown in FIG. 6, sub-scanning equivalent to a paper feed amount of six dots is carried out each time a main scanning pass is completed.

The right side of FIG. 6 shows the type of nozzle group set used for pixel recording and the associated ink discharge sequence for the pixels in each pixel position on each raster line (also termed the dot position). The pixels recorded by the first nozzle group set are indicated by diamond-shaped marks, while the pixels recorded by the second nozzle group set are indicated by circular marks. In addition, the first type of pixels having the first ink discharge sequence of YMCK are indicated by blank marks, while the second type of pixels having the second ink discharge sequence of KCMY are indicated by shaded marks.

The nozzle $N_Z$ used during recording of a raster line (also termed a main scanning line) during each main scanning pass is connected by a dashed line with the ordinal number of the associated raster line. For example, the two raster lines having the raster line numbers 2 and 6, respectively, are recorded during Pass 1 by the first nozzle group set N11S (forward path main scanning). The three raster lines having the raster line numbers 7, 11 and 15, respectively, are recorded during Pass 4 (reverse path main scanning) by the second nozzle group set N12S. Because not all raster lines can be used for recording, raster lines disposed above the raster line 1 are not used for printing.

In the example shown in FIG. 6, bidirectional printing that uses both the first and second nozzle group sets during each main scanning pass (hereinafter termed 'a first type of bidirectional printing') is executed. During a main scanning pass, each nozzle can record the pixels at all pixel positions on its associated raster line. In other words, the raster line associated with each nozzle is recorded by that nozzle during one main scanning pass. During the first main scanning pass (forward path main scanning), of the multiple nozzles of the print head 28A, those nozzles that are positioned below the raster line 1 are used for recording of the raster lines 2 and 6. These raster lines are recorded by the nozzle groups belonging to the first nozzle group set N11S, and the associated ink discharge sequence is YMCK. After the first main scanning pass is completed, sub-scanning using a paper feed amount F of six dots is performed, and the second main scanning pass (reverse path main scanning) is carried out. In the second main scanning pass, the raster lines 3, 4, 8 and 12 are recorded using the nozzles that are positioned below the raster line 1. Of these four raster lines, the raster line 3 is recorded by the nozzle groups belonging to the second nozzle group set N12S, and the associated ink discharge sequence is YMCK. The raster lines 4, 8 and 12 are recorded by the nozzle groups belonging to the first nozzle group set N11S, and the associated ink discharge sequence is KCMY. After the second scanning pass is completed, sub-scanning using a paper feed amount F of six dots is performed, and the third main scanning pass (forward path main scanning) is carried out. Because all nozzles are positioned below the raster line 1 during all main scanning passes beginning with the third main scanning pass, printing can be executed using all nozzles. In the third main scanning pass, the raster lines 10, 14 and 18 are recorded using the first nozzle group set N11S and the raster lines 1, 5 and 10 are recorded using the second nozzle group set N12S. Image printing is executed through the repetition of these operations.

In the example shown in FIG. 6, because the first nozzle group set N11S and the second nozzle group set N12S are used during both forward path and reverse path main scanning, high-speed bidirectional printing can be achieved.

In the example shown in FIG. 6, a first-type pixel pair and a second-type pixel pair are recorded in an alternating fashion along the sub-scanning direction. To the human eye, when the same pattern is repeated, the entire image is perceived as a consistent image, without much attention being paid to any local pattern. Therefore, color unevenness caused by conspicuous regions can be prevented by repeating different types of pixels in an essentially cyclical fashion. In the example shown in FIG. 6, color unevenness can be minimized even when such repetition is carried out according to different cycles. For example, where first-type pixels are termed 'L' and second-type pixels are termed 'R', an arrangement in which the pixel pattern 'LLR' is repeated may be used. If the width of a region in which raster lines comprising pixels of the same type run continuously (two pixels in this example) becomes larger, this continuous region may easily tend to become conspicuous, even in an arrangement in which continuous regions are repeated in a cyclical fashion. For this reason, it is preferred that regions over which raster lines of the same type run continuously have a width of no more than 1000 $\mu$m, and more preferably no more than 500 $\mu$m. For example, where a print system having a print resolution of 360 dpi is used (i.e., where D is approximately 70 $\mu$m), it is particularly preferred that regions in which raster lines of the same type run continuously have a width of no more than seven pixels (i.e., 490 $\mu$m). Furthermore, in general, it is most preferred that such regions have a width of no more than two pixels irrespective of the print resolution.

In the example shown in FIG. 6, it is assumed that the values of n and m for the print head 28A shown in FIG. 5 are '4' and '1', respectively, and that each nozzle group is composed of three nozzles, but a construction that combines different values for the integers n and m, the number of nozzles and the sub-scanning feed amount F may be used. In such a print system having a different combination of such values as well, color unevenness due to conspicuous regions can be reduced through a construction in which first-type pixels and second-type pixels are recorded in an essentially cyclical fashion.

The ink discharge sequence can be freely determined in consideration of the characteristics of the types of ink used. For example, the ink colors may be discharged in the sequence of CMYK.

C. Second Embodiment

Figure 7:
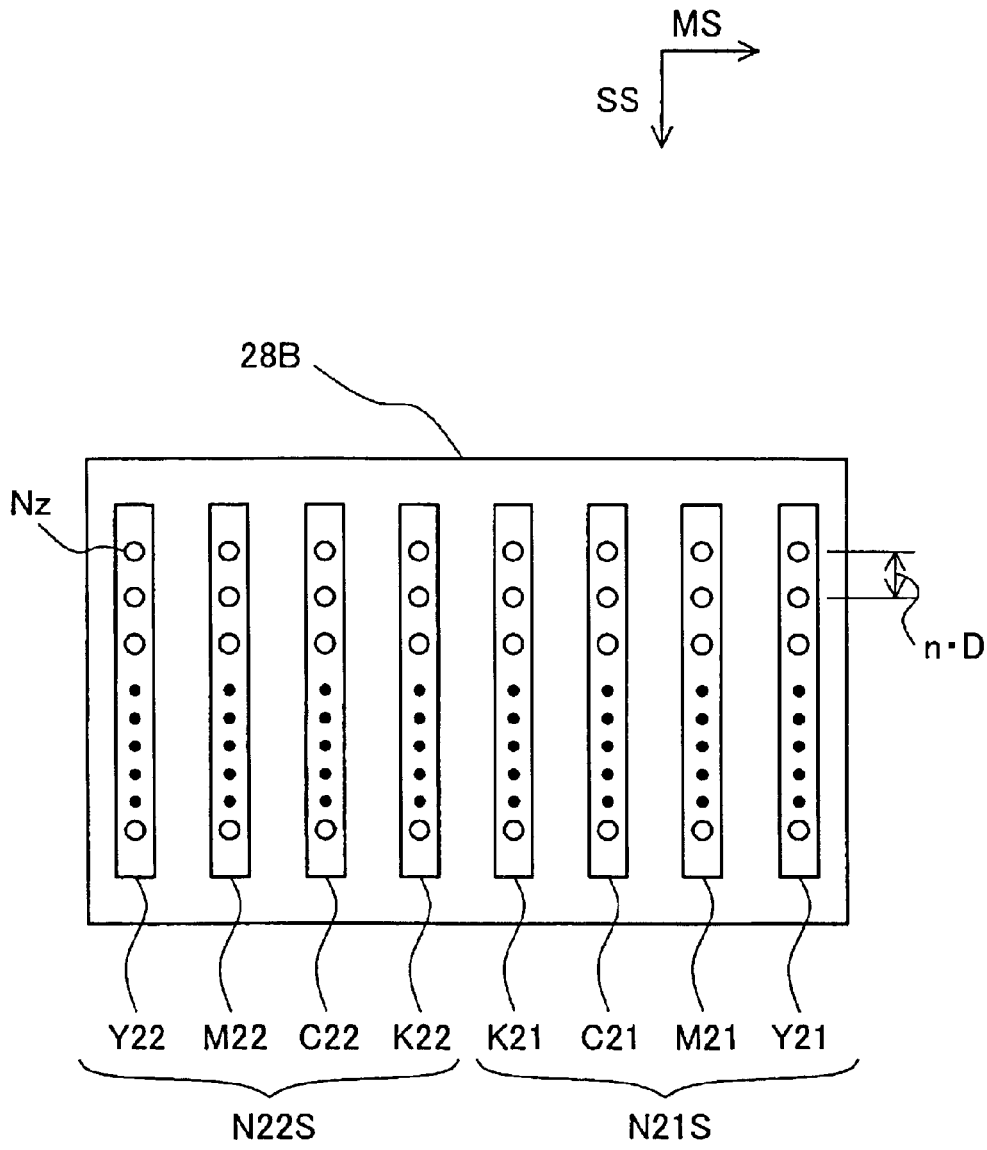
FIG. 7 is an explanatory drawing showing the nozzle arrangement on the bottom of a print head 28B of a second embodiment.

FIG. 7 is an explanatory drawing that shows the arrangement of nozzles on the bottom of a print head 28B of a second embodiment. This embodiment differs from the first embodiment shown in FIG. 5 only in that the first nozzle group set N21S and the second nozzle group set N22S are aligned in the main scanning direction instead of the sub-scanning direction. The eight nozzle groups Y22, M22, C22, K22, K21, C21, M21 and Y21 arranged along the main scanning forward path are aligned such that they have the same position in the sub-scanning direction. The four nozzle groups K21, C21, M21 and Y21 of the first nozzle group set N21S discharge the four colors K, C, M and Y, respectively. Similarly, the four nozzles K22, C22, M22 and Y22 of the second nozzle group set N22S also discharge the four colors K, C, M and Y, respectively.

Figure 8:
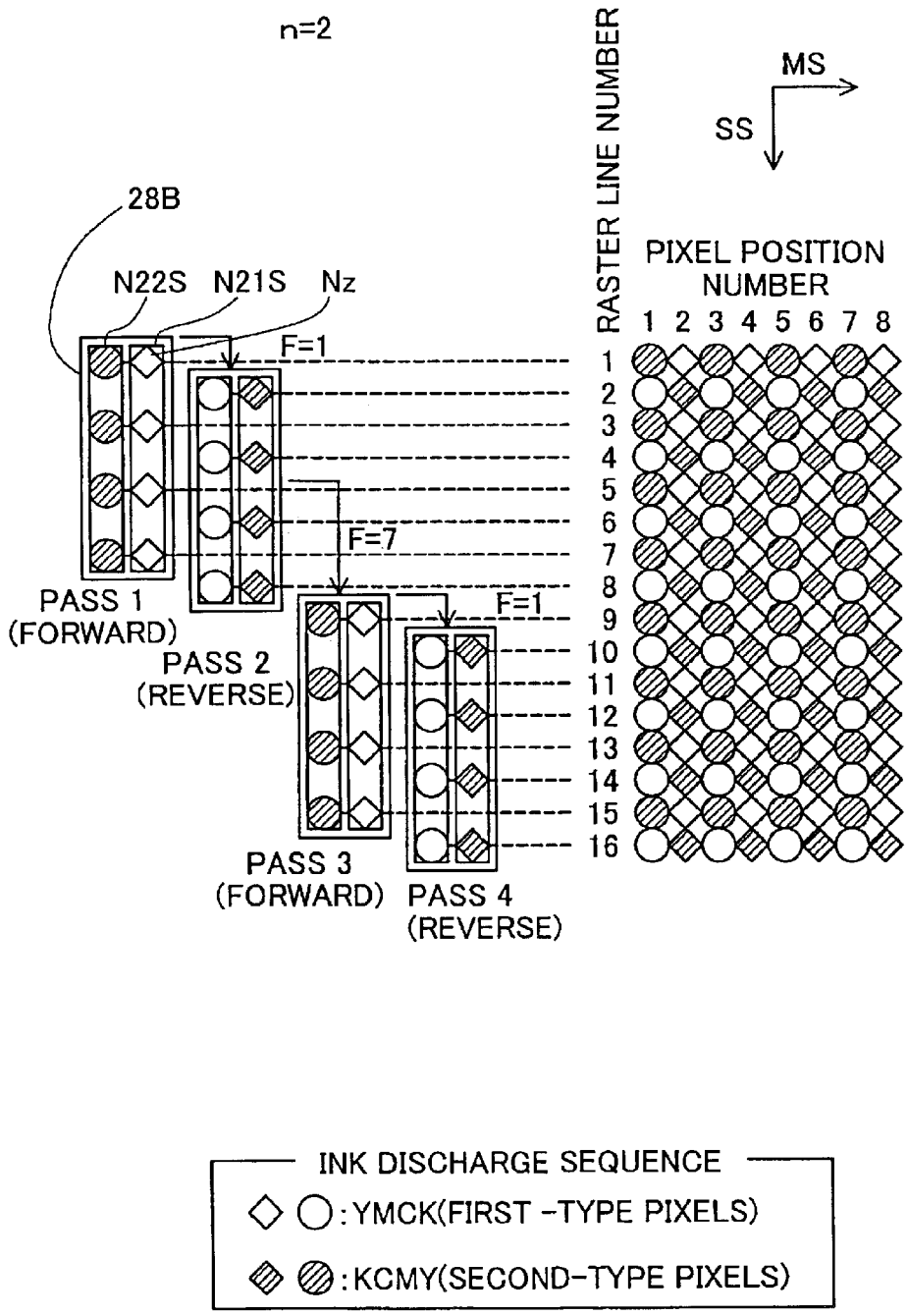
FIG. 8 is an explanatory drawing that describes an example of bidirectional printing.

FIG. 8 is an explanatory drawing that describes an example of bidirectional printing using the print head 28B of the second embodiment. In FIG. 8, an example is shown in which the value of n for the print head 28B shown in FIG. 7 is '2', and each nozzle group has four nozzles. The characters and symbols in the drawing have the same meanings as in FIG. 6.

The printing method of this embodiment differs from that shown in FIG. 6 in that in one main scanning pass, each nozzle records every other pixel in a raster line. With this construction, the two nozzle group sets can scan the same raster line in one main scanning pass, and the pixels in one raster line are recorded by the two nozzle group sets in an alternating fashion. In other words, each raster line is recorded using the nozzles of the two nozzle group sets in one main scanning pass. During the first main scanning pass (forward path main scanning), the raster lines 1, 3, 5 and 7 are recorded. Here, pixels having an even-numbered pixel position are recorded by the first nozzle group set N21S and pixels having an odd-numbered pixel position are recorded by the second nozzle group set N22S. Therefore, first-type and second-type pixels are recorded in an alternating fashion in the main scanning direction. After the first main scanning pass is completed, sub-scanning is performed using a paper feed amount F of one dot, and the second main scanning pass (reverse path main scanning) is performed. In the second main scanning pass, the raster lines 2, 4, 6 and 8 are recorded. As during the first main scanning pass, the pixels having an even-numbered pixel position are recorded by the first nozzle group set N21S, and pixels having an odd-numbered pixel position are recorded by the second nozzle group set N22S. In addition, the ink discharge sequence during reverse path main scanning for ink colors discharged from either nozzle group set is the reverse of the sequence for such nozzle group set during forward path main scanning. Therefore, eight raster lines are recorded at this stage (the raster lines 1–8), and the first-type and second-type pixels in these raster lines are recorded in an alternating fashion in the direction of the main scanning path and the direction of sub-scanning. After the second main scanning pass is completed, sub-scanning is performed using a paper feed amount F of seven dots, and the third main scanning pass (forward path main scanning) is performed. Image printing is executed by repeating these operations.

As described above, in the example shown in FIG. 8, because the first nozzle group set N21S and the second nozzle group set N22S are used during both forward path main scanning and reverse path main scanning, high-speed bidirectional printing can be achieved.

In the example shown in FIG. 8, first-type pixels and second-type pixels are recorded in an alternating fashion in the main scanning direction and the sub-scanning direction. Therefore, color unevenness due to conspicuous regions can be reduced. In the example shown in FIG. 8, the pattern of repeating first-type pixels and second-type pixels and the cycle of such repetition is the same for both the main scanning direction and the sub-scanning direction. However, color unevenness can be further reduced using an arrangement in which the pattern and cycle are different depending on the direction. For example, where first-type pixels are termed 'L' and second type pixels are termed 'R', an arrangement in which the pattern 'LR' is repeated along the main scanning direction and the pattern 'LLRR' is repeated along the sub-scanning direction may be used. Furthermore, another arrangement may be adopted in which the pattern and cycle vary depending on the raster line number and the pixel position number even for the same scanning direction.

Figure 9A:
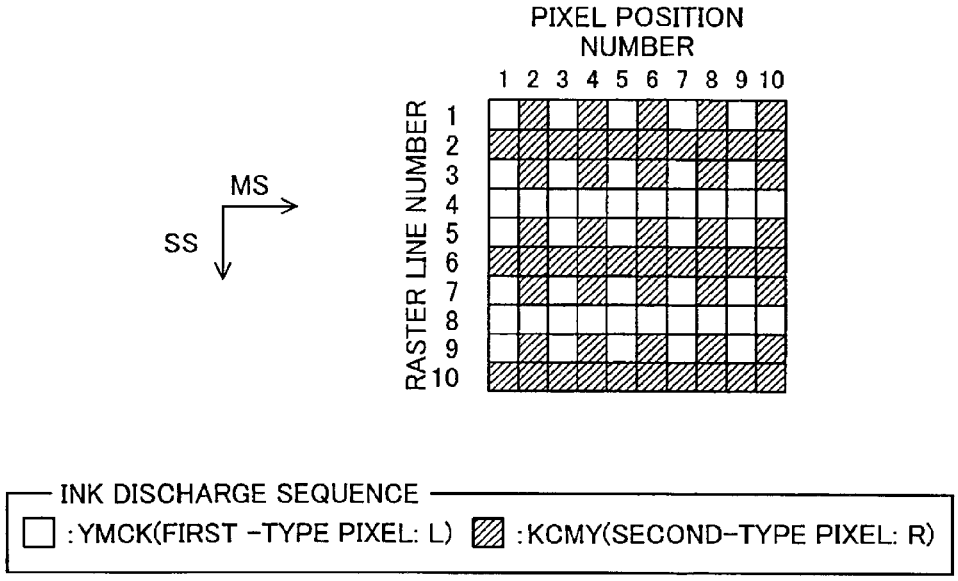
FIGS. 9(*a*) and 9(*b*) are drawings showing an example of pixel alignment.
Figure 9B:
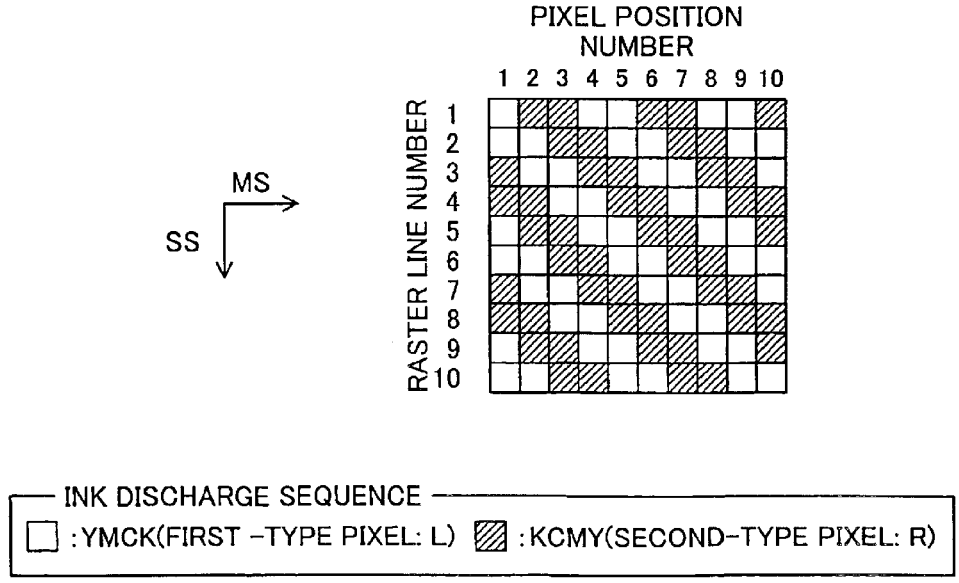

FIGS. 9(*a*) and 9(*b*) are drawings showing different examples of pixel placement. In the example shown in FIG. 9(*a*), the repeating pattern in the sub-scanning direction is 'LRLL' for pixel columns at odd-numbered pixel positions, while the repeating pattern in the sub-scanning direction is 'RRRL' for pixel columns at even-numbered pixel positions. In this case, the main scanning direction repeating pattern for odd-numbered raster lines is 'LR'. For even-numbered raster lines, raster lines having 'L' pixels only and raster lines having 'R' pixels only are alternately repeated. In the example shown in FIG. 9(*b*), the sub-scanning direction repeating pattern is 'LLRR' for all pixel columns. In this arrangement, the position at which this 'LLRR' repeating pattern appears is offset in the sub-scanning direction by one pixel each time the pixel position number increases by one. As a result, diagonal lines formed by first-type pixels 'L' and the second-type pixels 'R' alternate in a repeating fashion. In this case, the repeating pattern in the main scanning direction is 'LLRR' for all raster lines as well, such that the position at which this pattern appears is offset in the main scanning direction by one pixel each time the raster line number increases by one. In either example, color unevenness due to conspicuous regions can be reduced through an arrangement in which these patterns are repeated in a cyclical fashion.

In regions where same-type pixels repeat, if both the maximum continuous number of such pixels in the main scanning direction and the maximum continuous number of such pixels in the sub-scanning direction are large, even in an arrangement in which these continuous-pixel regions are repeated in a cyclical fashion, such regions become conspicuous and can be easily perceived as color unevenness. Consequently, it is preferred that a pattern construction be used wherein at least one of the maximum continuous number of same-type pixels in the main scanning direction and the maximum continuous number of such pixels in the sub-scanning direction is not large. In the example shown in FIG. 9(*a*), in regions where first-type pixels run continuously, the number of continuous first-type pixels in the sub-scanning direction is three for odd-numbered pixel columns and one for even-numbered pixel columns. In other words, the maximum number of continuous same-type pixels is three. Similarly, in regions where second-type pixels run continuously, the number of continuous second-type pixels in the sub-scanning direction is one for odd-numbered pixel columns and three for even-numbered pixel columns, such that the maximum number of continuous same-type pixels is three. In the example shown in FIG. 9(*b*), in regions where first-type pixels run continuously, the number of continuous first-type pixels in the sub-scanning direction is two for both odd-numbered and even-numbered pixel columns, and the number of continuous first-type pixels in the main scanning direction is also two for both odd-numbered and even-numbered pixel columns, such that the maximum number of continuous same-type pixels is two. Similarly, in regions where second-type pixels run continuously, the number of continuous second-type pixels in the sub-scanning direction is two for both odd-numbered pixel columns and even-numbered pixel columns, and the number of continuous second-type pixels in the main scanning direction is also two for both odd-numbered and even-numbered pixel columns, such that the maximum number of continuous same-type pixels is two. In order to eliminate color unevenness, it is preferred that in regions where same-type pixels run continuously, at least one of the maximum length in the main scanning direction (the length obtained when pixels continue in the main scanning direction for the maximum number of pixels for the main scanning direction) and the maximum length in the sub-scanning direction (the length obtained when pixels continue in the sub-scanning direction for the maximum number of pixels for the sub-scanning direction) be no more than 1000 $\mu$m, and more preferably no more than 500 $\mu$m. For example, in a printing system in which the print resolution is 360 dpi (i.e., where D is approximately 70 $\mu$m), it is particularly preferred that in regions in which same-type pixels run continuously, the maximum number of continuous same-type pixels be no more than seven pixels in at least one of the main scanning direction and the sub-scanning direction. Furthermore, it is most preferred that such regions have a maximum number of continuous same-type pixels of no more than two pixels in at least one of the main scanning direction and the sub-scanning direction irrespective of the print resolution.

In the example shown in FIG. 8, the first nozzle group set N21S performs recording of pixels at an even-numbered pixel position, while the second nozzle group set N22S performs recording of pixels at an odd-numbered pixel position, but a construction may be adopted in which the pixel position numbers for the pixels to be recorded by the two nozzle group sets alternate for forward path main scanning and reverse path main scanning. For example, in such a construction, during forward path main scanning, even-numbered pixels are recorded by the first nozzle group set and odd-numbered pixels are recorded by the second nozzle group set. Conversely, during reverse path main scanning, odd-numbered pixels are recorded by the first nozzle group set and even-numbered pixels are recorded by the second nozzle group set. Through these operations, recording of multiple pixels having the same pixel position number can be performed by both the first and second nozzle group sets. Therefore, pixels as to which the recording position is misaligned due to errors in the amount of movement in the main scanning direction or manufacturing errors regarding the nozzle position on the print head, for example, are prevented from becoming concentrated in particular pixel columns, i.e., in pixels having a particular pixel position number, and the effect of such misalignment on image quality can be minimized. Moreover, in this example, because first-type pixels and second-type pixels are recorded in an alternating fashion in the main scanning direction, color unevenness can be prevented.

Because each nozzle group on the print head 28B of the second embodiment has an identical width in the sub-scanning direction, the width of the print head 28B in the sub-scanning direction is smaller than in the first embodiment, allowing the apparatus to be reduced in size. Furthermore, the gap between the holding mechanisms, such as rollers, that hold the printing medium on both sides in the sub-scanning direction of the print head 28B can be reduced. Therefore, errors in image printing due to crimping of the printing medium that faces the print head can be prevented.

Generally, relative misalignment of the ink dot formation position is smaller for the inner nozzle groups, and is larger for the outer nozzle groups. In the embodiment shown in FIG. 7, because the yellow ink discharged by the two outermost nozzle groups Y21 and Y22 is less visible than the black ink discharged by the two innermost nozzle groups K21 and K22, misalignment in the ink dot formation position can be made less conspicuous.

The effect of ink dot position misalignment on image quality can be minimized through a construction in which the more visible ink is discharged from the nozzle groups closer to the inside. For example, among the four ink colors, i.e., KCMY, it is believed that the visibility increases in the order of KCMY (K having the highest visibility and Y the lowest). In the embodiment shown in FIG. 7, because the arrangement of ink colors discharged by each nozzle group constitutes the sequence of KCMY from the inner nozzles to the outer nozzles, the effect of ink dot position misalignment on image quality can be reduced.

D. Third Embodiment

Figure 10:
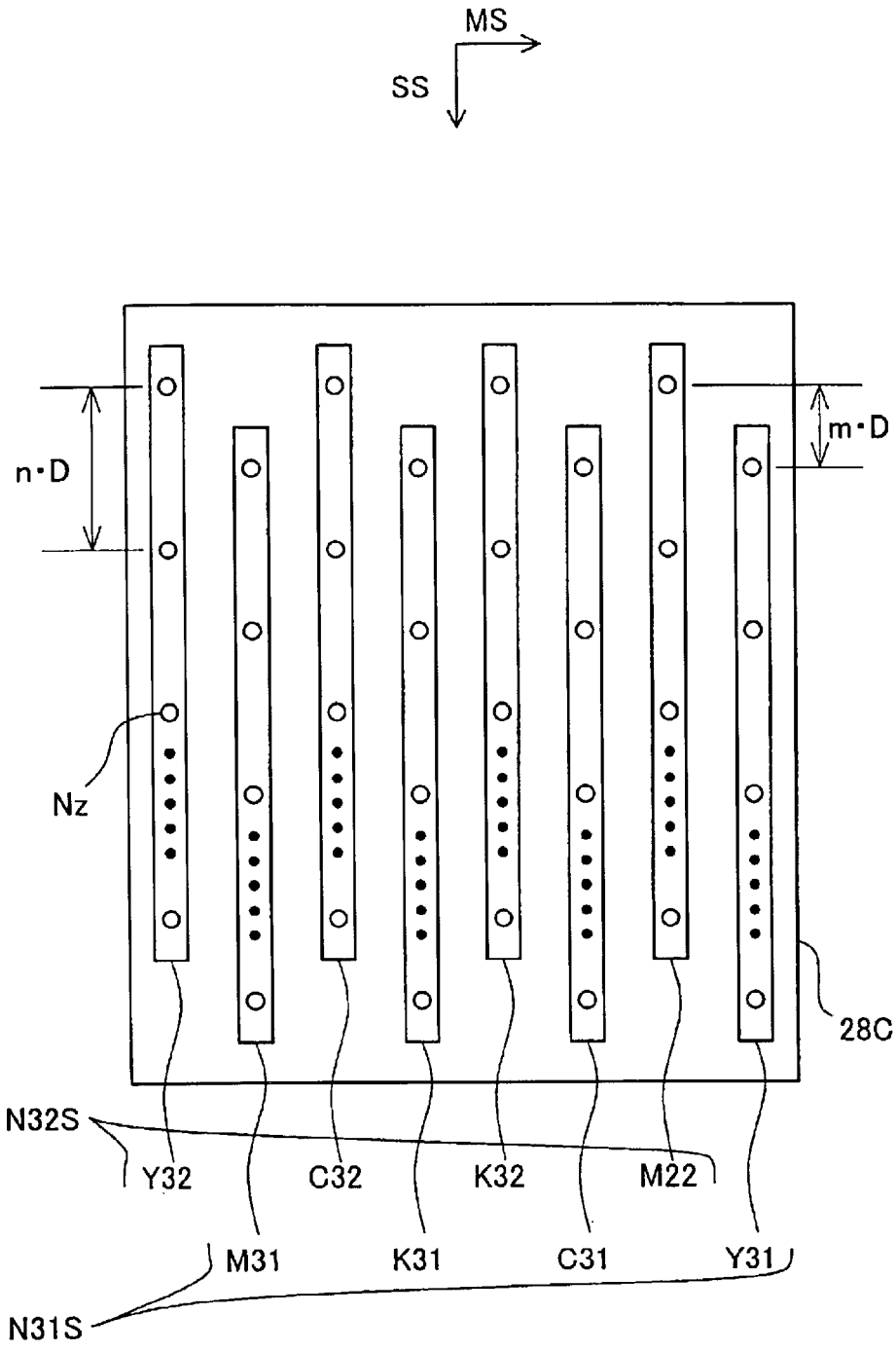
FIG. 10 is an explanatory drawing showing the nozzle arrangement on the bottom of a print head 28C of a third embodiment.

FIG. 10 is an explanatory drawing showing the nozzle arrangement on the bottom of a print head 28C of a third embodiment. There are two differences between this embodiment and the second embodiment shown in FIG. 7. First, the first nozzle group set N31S and the second nozzle group set N32S are placed such that they are offset from each other in the sub-scanning direction by the distance m·D where m is a positive integer smaller than n. Second, the nozzle groups belonging to the first nozzle group set N31S and the nozzle groups belonging to the second nozzle group set N32S are arranged in an alternating fashion. The eight nozzle groups are arranged in the sequence of Y32, M31, C32, K31, K32, C31, M32, Y31 in the direction of forward path main scanning. In other words, the four nozzle groups comprising the first nozzle group set N31S are arranged in the sequence of M31, K31, C31 and Y31 in the direction of forward path main scanning (the first sequence), and discharge the four ink colors of M, K, C and Y, respectively. Conversely, the four nozzle groups comprising the second nozzle group set N32S are arranged in the sequence of Y32, C32, K32 and M32 in the direction of forward path main scanning (the second sequence), and discharge the four ink colors of Y, C, K and M, respectively.

Like the print head 28B of the second embodiment, the print head 28C of this third embodiment has a construction in which the center two nozzle groups discharge black ink and the outer most nozzle groups discharge yellow ink, thereby reducing the effect of ink dot position misalignment on image quality. Any other desired arrangement of the nozzle groups that discharge the various colors can be used. However, because using the center two nozzle groups to discharge black ink allows the formation position misalignment of black ink dots to be minimized, this arrangement is preferred from the standpoint of improving the image quality of monochrome text printing, which is frequently performed.

Figure 11:
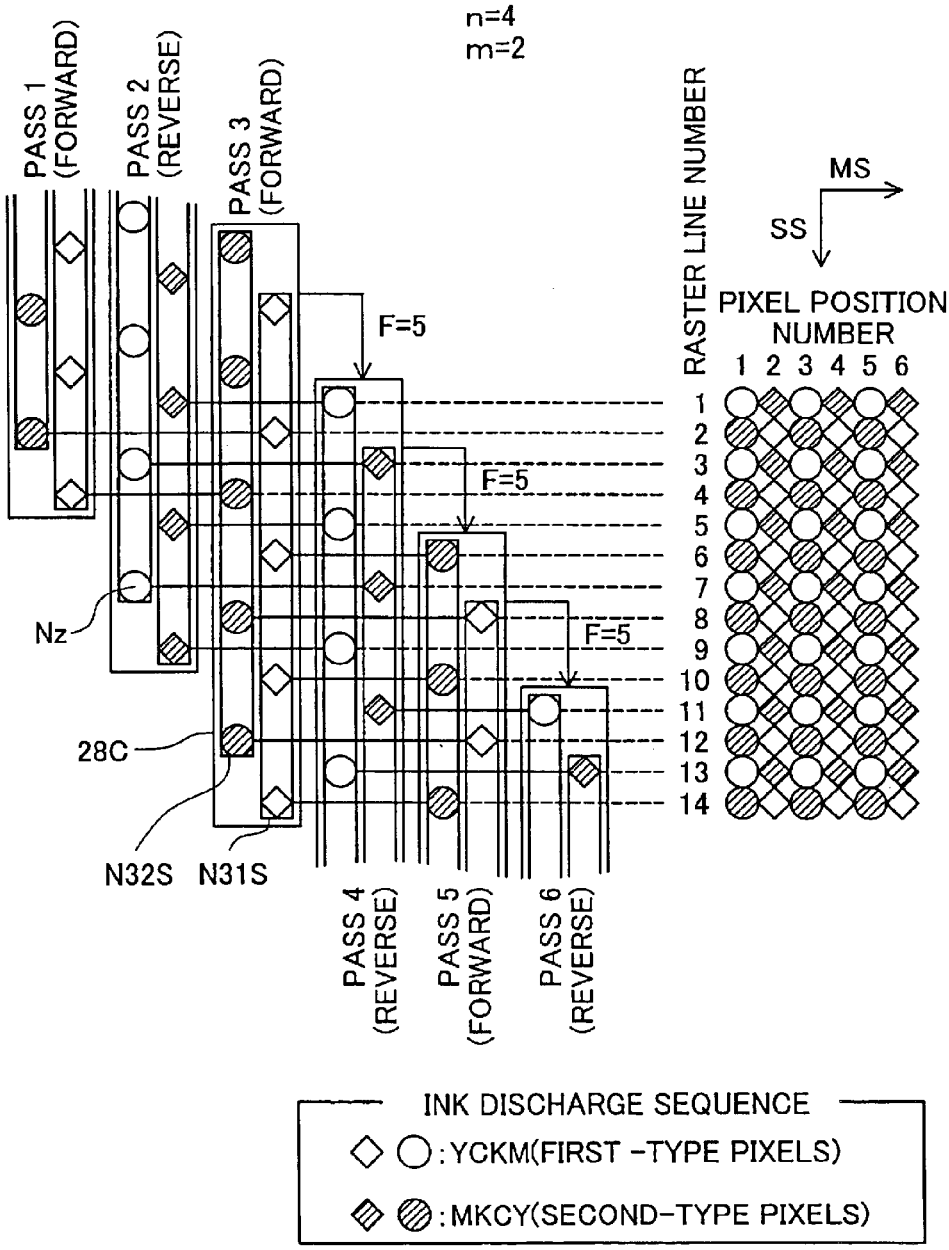
FIG. 11 is an explanatory drawing that describes an example of bidirectional printing.

FIG. 11 is an explanatory drawing that describes an example of bidirectional printing using the print head 28C of the third embodiment. FIG. 11 describes an example in which the values of n and m for the print head 28C shown in FIG. 10 are '4' and '2', respectively, and each nozzle group has five nozzles. The characters and symbols in FIG. 11 have the same meanings as in FIG. 6.

This printing method differs from the printing method shown in FIG. 8 in that overlap printing is carried out, wherein one raster line is recorded in two main scanning passes. In each main scanning pass, the nozzles of the first nozzle group set N31S record pixels having an even-numbered pixel position, while the nozzles of the second nozzle group set N32S record pixels having an odd-numbered pixel position. The two nozzle group sets each perform recording of different raster lines. Therefore, the recording of the multiple pixels of a raster line is not completed in one main scanning pass, but in two main scanning passes. Sub-scanning using a paper feed amount F of five dots is performed each time a main scanning pass is completed. Because recording cannot take place for any of the raster lines above the first raster line, they are not used for printing.

In the example shown in FIG. 11, pixels belonging to odd-numbered raster lines are recorded during reverse path main scanning, while pixels belonging to even-numbered raster lines are recorded during forward path main scanning. In other words, the raster lines recorded during reverse path main scanning and the raster lines recorded during forward path main scanning are recorded in an alternating fashion. Furthermore, pixels having an odd-numbered pixel position are recorded by the second nozzle group set N32S, while pixels having an even-numbered pixel position are recorded by the first nozzle group set N31S. In other words, the pixel columns recorded by the first nozzle group set N31S and the pixel columns recorded by the second nozzle group set N32S are recorded in an alternating fashion. Therefore, first-type pixels for which the ink discharge sequence is YCKM (the first discharge sequence) and second-type pixels for which the ink discharge sequence is MKCY (the second discharge sequence) are recorded in an alternating fashion in both the main scanning direction and the sub-scanning direction. Consequently, color unevenness due to conspicuous regions can be prevented. Moreover, because one raster line is recorded in multiple main scanning passes, pixels as to which the pixel recording position is misaligned due to errors in the amount of movement in the sub-scanning direction or manufacturing errors regarding the nozzle position on the print head, for example, can be prevented from becoming concentrated in particular raster line, and streakiness can be prevented from becoming conspicuous in the area around that raster line. In other words, the effect of pixel recording position misalignment on image quality can be minimized. In the example shown in FIG. 11, because this type of overlap printing is achieved through the first type of bidirectional printing in which both the first and second nozzle group sets are used during both forward path main scanning and reverse path main scanning, high-speed, high-quality printing can be executed. In the example shown in FIG. 11, it is assumed that the values of n and m for the print head 28C shown in FIG. 10 are '4' and '2', respectively, and that each nozzle group is composed of five nozzles, but this first type of bidirectional printing, wherein color unevenness due to conspicuous regions can be reduced as described above, can also be executed in a construction that combines different values for the integers n and m, the number of nozzles and the sub-scanning feed amount.

E. Fourth Embodiment

Figure 12:
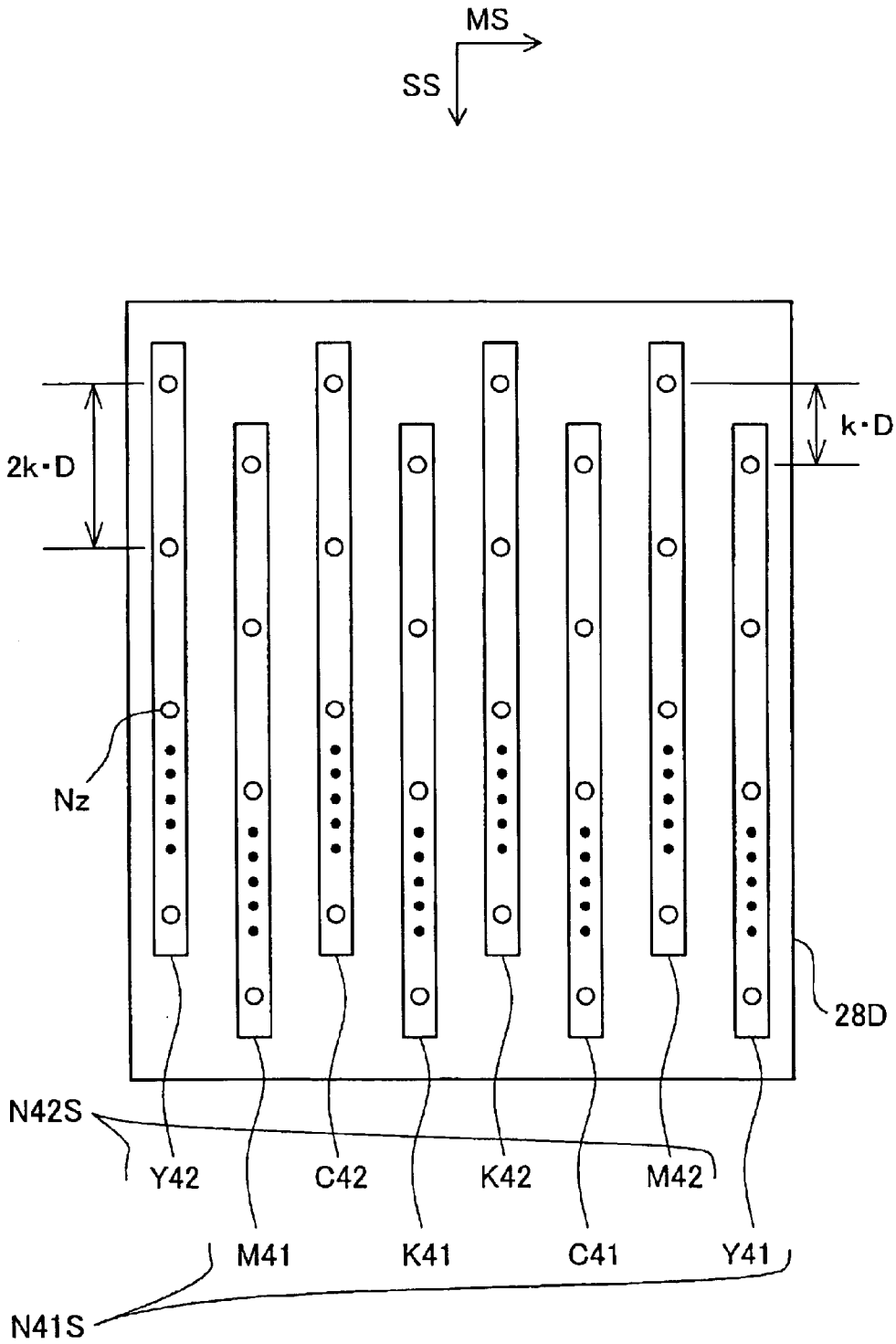
FIG. 12 is an explanatory drawing showing the nozzle arrangement on the bottom of a print head 28D of a fourth embodiment.

FIG. 12 is an explanatory drawing showing the nozzle arrangement on the bottom of a print head 28D of a fourth embodiment. Unlike in the third embodiment shown in FIG. 10, the nozzle pitch for each nozzle group is 2k·D where k is an odd number, and the position of the second nozzle group set N42S in the sub-scanning direction is offset from the position of the first nozzle group set N41S in the sub-scanning direction by the distance k·D. The four nozzle groups comprising the first nozzle group set N41S are arranged in the sequence of M41, K41, C41, Y41 in the direction of forward path main scanning (the first sequence), and discharge the four ink colors of M, K, C and Y, respectively. Conversely, the four nozzle groups comprising the second nozzle group set N42S are arranged in the sequence of Y42, C42, K42 and M42 (the second sequence), and discharge the four ink colors of Y, C, K and M, respectively.

Figure 13:
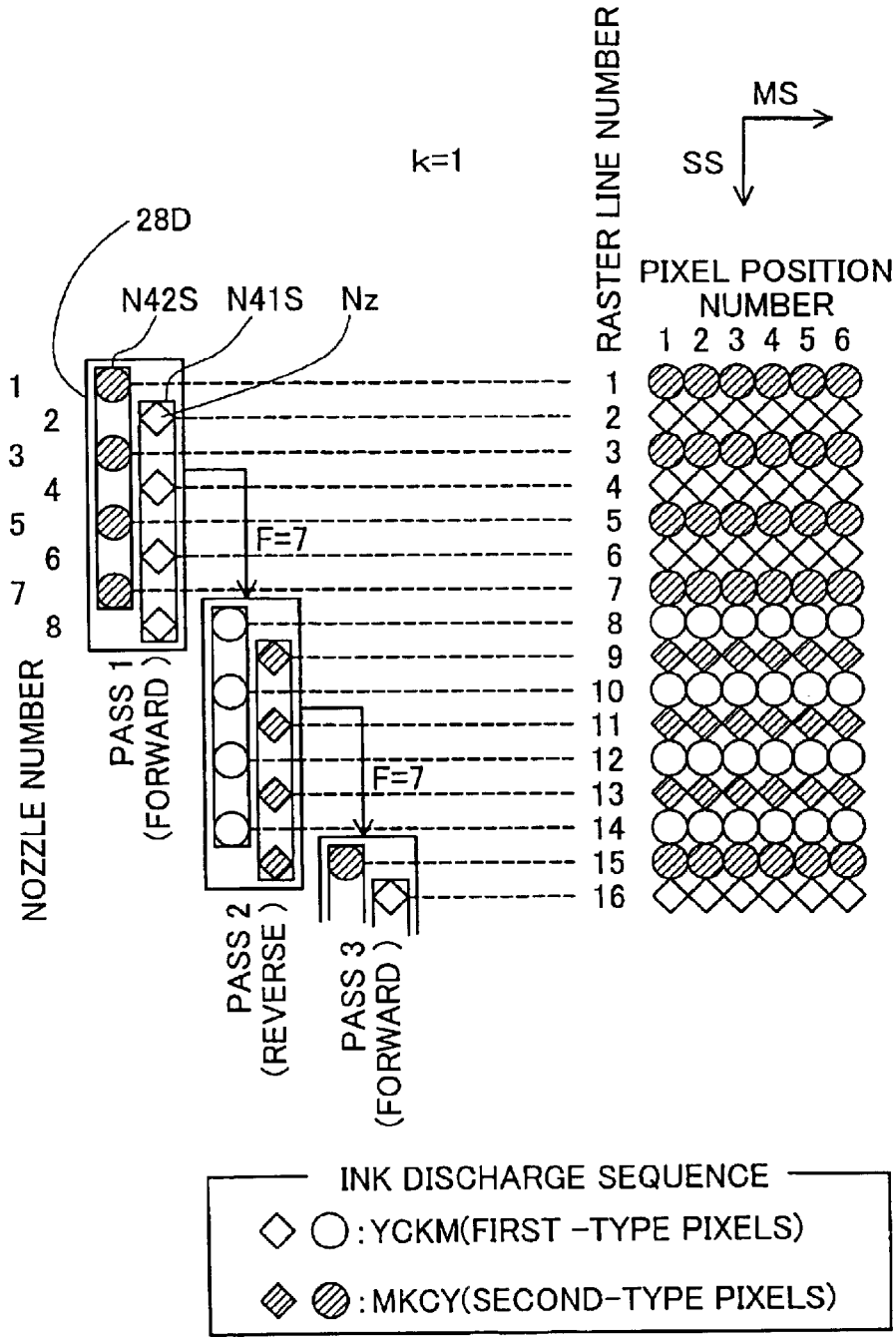
FIG. 13 is an explanatory drawing that describes an example of bidirectional printing.

FIG. 13 is an explanatory drawing that describes an example of bidirectional printing using the print head 28D of the fourth embodiment. FIG. 13 describes an example in which the value of k for the print head 28D shown in FIG. 12 is '1', and each nozzle group has four nozzles. The characters and symbols in FIG. 13 have the same meanings as in FIG. 6.

This fourth embodiment differs from the embodiments described above in that of the nozzles that can be used to discharge the various ink colors, only seven nozzles, an odd number, are used. The nozzle numbers shown at the left side of the print head 28D in connection with Pass 1 are assigned, in the sequence of the sub-scanning direction, to the eight nozzles that can be used to discharge the various colors of ink. In the example shown in FIG. 13, of the eight nozzles on the print head 28D, only the seven nozzles having the nozzle numbers 1 through 7 are used for printing. During the first main scanning pass (forward path main scanning), the four nozzles of the second nozzle group set N42S having the nozzle numbers 1, 3, 5 and 7 are used for recording of the raster lines 1, 3, 5 and 7. The three nozzles of the first nozzle group set N41S having the nozzle numbers 2, 4 and 6 are used for recording of the raster lines 2, 4 and 6. In this operation, the raster lines 1 through 7 are recorded.

After the first main scanning pass has been completed, sub-scanning is performed using a paper feed amount F of seven dots, whereupon the second main scanning pass (reverse path main scanning) is performed. In the second main scanning pass as well, printing is executed using only the seven nozzles having the nozzle numbers 1 through 7. Printing is executed by repeating these operations. As a result, first-type pixels for which ink is discharged in the ink discharge sequence YCKM (the first sequence) and second-type pixels for which ink is discharged in the ink discharge sequence MKCY (the second sequence) are recorded in an alternating fashion in the sub-scanning direction. Therefore, because the two types of pixels offset each other, i.e., prevent areas composed of the other type of pixel from becoming conspicuous, color unevenness can be reduced.

In FIG. 13, it is assumed that each nozzle group in the print head 28D shown in FIG. 12 has four nozzles, but in general, color unevenness can be prevented by using an odd number of nozzles to discharge the various ink colors as well.

Figure 14:
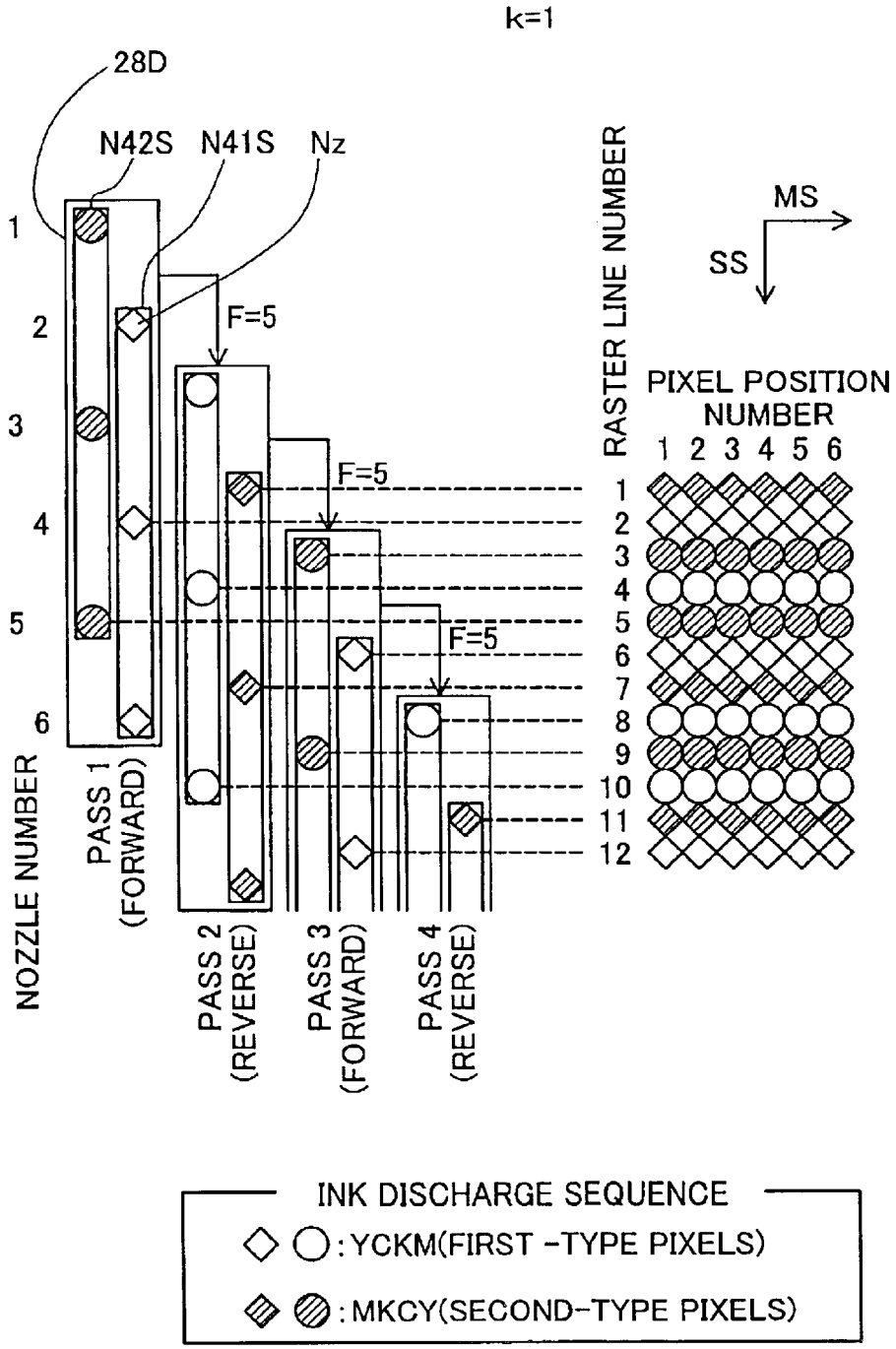
FIG. 14 is an explanatory drawing that describes an example of bidirectional printing.

FIG. 14 is an explanatory drawing that describes another example of bidirectional printing using the print head 28D of the fourth embodiment. FIG. 14 describes an example in which the value of k for the print head 28D shown in FIG. 12 is '3', and each nozzle group has four nozzles. The characters and symbols in FIG. 14 have the same meanings as in FIG. 13.

In the example shown in FIG. 14, as in the example shown in FIG. 13, the first type of bidirectional printing is executed using five nozzles (an odd number of nozzles) having the nozzle numbers 1 through 5. Unlike in the example shown in FIG. 13, however, each time a main scanning pass is completed, sub-scanning using a constant paper feed amount F of five dots is performed. As a result, first-type pixels and second-type pixels are recorded in an alternating fashion in the sub-scanning direction. Therefore, because the two types of pixels offset each other and prevent areas composed of the other type of pixel from becoming conspicuous, color unevenness can be reduced. Moreover, because not all raster lines can be used for recording, raster lines located above the raster line 1 are not used for printing.

In general, when printing is executed using N number of nozzles aligned with a nozzle pitch of k·D, by ensuring that k and N are integers prime to each other, and carrying out sub-scanning using a paper feed amount of N dots each time a main scanning pass is completed, all raster lines can be recorded without a gap therebetween (so-called constant feed interlaced printing). Where the first type of bidirectional printing is executed using a print head in which the nozzles of the first nozzle group set and the nozzles of the second nozzle group set are aligned in an alternating fashion with a nozzle pitch of k·D, recording of all raster lines can also be performed if the print head construction satisfies these conditions. Here, in order to ensure that first-type pixels and second-type pixels are aligned in a perfectly alternating fashion in the sub-scanning direction, two more conditions must be satisfied:

| | |
|---|---|
| Condition C1: | k is an odd number. |
| Condition C2: | N is an odd number. |

These two conditions C1 and C2 may be understood from the explanation below.

Where first-type pixels and second-type pixels are arranged in an alternating fashion in the sub-scanning direction, the gap separating any given first-type pixel and second-type pixel constitutes an odd number of dots. Therefore, the gap k·D separating the nozzles of the first nozzle group set and the nozzles of the second nozzle group set (see FIG. 12) must also constitute an odd number of dots. In other words, the condition C1 requiring that k be an odd number is necessary.

In constant feed interlaced printing, after one main scanning pass is completed, sub-scanning using a paper feed amount of N dots is performed, whereupon the next main scanning pass is carried out. By repeating forward path main scanning and reverse path main scanning, the raster lines can be recorded in sequence, wherein each nozzle having the same nozzle number performs recording of every Nth raster line. The ink discharge sequence for the nozzles having the same nozzle number is reversed for forward path main scanning and reverse path main scanning. In other words, the ink discharge sequence is reversed for every Nth raster line. If N is an even number, because it might occur that one of two raster lines separated by an even number of dots is recorded using first-type pixels while the other raster line is recorded using second-type pixels, it is not possible for the two types of pixels to be arranged in an alternating fashion in the sub-scanning direction. Therefore, the condition C2 requiring that N be an odd number is necessary.

By executing interlaced printing using an odd number of nozzles, where the gap between the nozzles of the first and second nozzle group sets constitutes an odd number of dots, the two types of pixels can be recorded in a perfectly alternating fashion in the sub-scanning direction. In the example shown in FIG. 14, the values for k and N are '3' and '5', respectively, which satisfies the above conditions C1 and C2.

F. Fifth Embodiment

Figure 15:
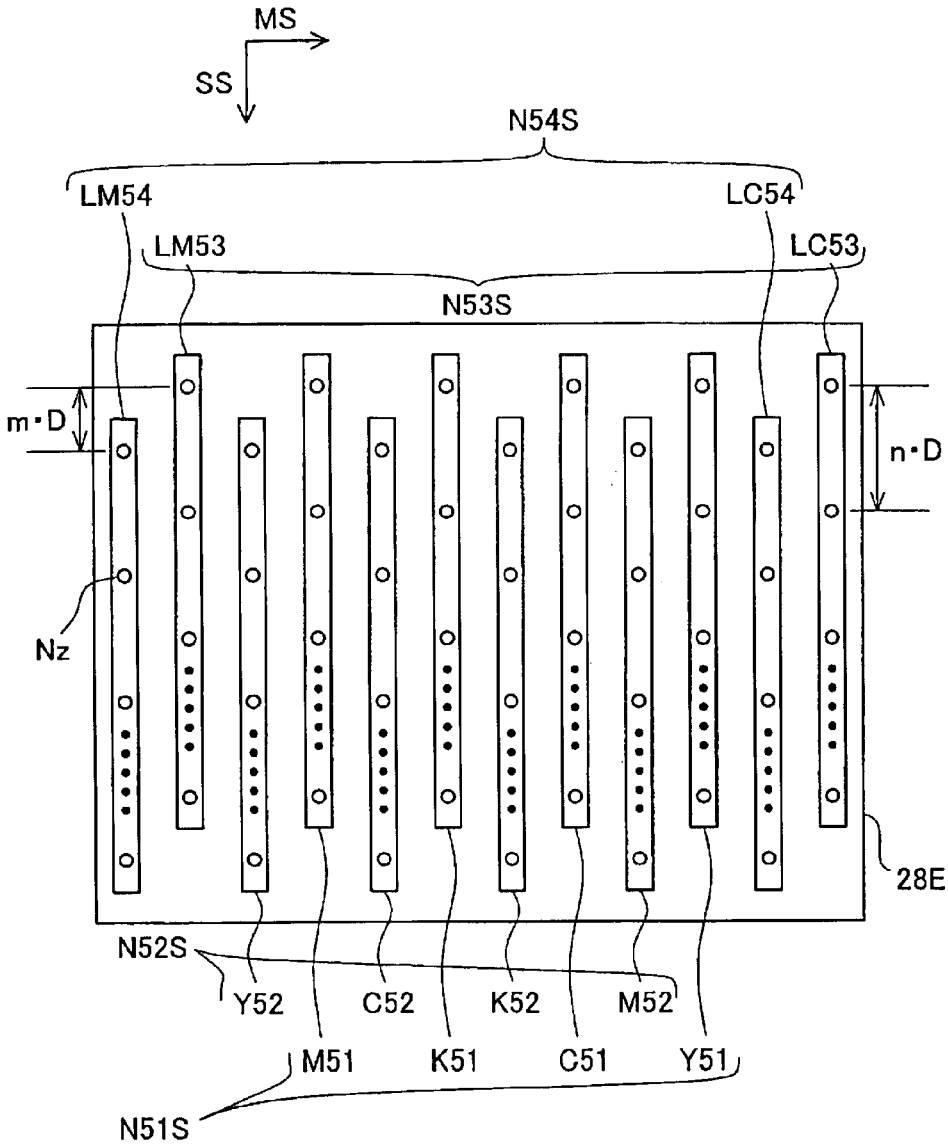
FIG. 15 is an explanatory drawing showing the nozzle arrangement on the bottom of a print head 28E of a fifth embodiment.

FIG. 15 is an explanatory drawing showing the arrangement of nozzles on the bottom of a print head 28E of a fifth embodiment. In addition to the nozzle groups of the third embodiment shown in FIG. 10, the print head 28E also includes a third nozzle group set N53S and a fourth nozzle group set N54S that discharge light cyan ink LC and light magenta ink LM. The light cyan ink LC is an ink having essentially the same hue as the cyan ink C but a lower concentration, while the light magenta ink LM is an ink having the same hue as the magenta ink M but a lower concentration. The third nozzle group set N53S is composed of the two nozzle groups LC53 and LM53, and the fourth nozzle group set N54S is composed of the two nozzle groups LC54 and LM54. Of these four nozzle groups, the nozzle groups LC53 and LC54 discharge light cyan ink, while the nozzle groups LM53 and LM54 discharge light magenta ink. In addition, the ink cartridge mounting section 62 (see FIG. 4) is constructed so as to permit the mounting of ink cartridges (not shown) containing the light cyan ink LC and the light magenta ink LM.

The nozzle groups comprising the third nozzle group set N53S have the same nozzle positions in the sub-scanning direction as the nozzles comprising the first nozzle group set N51S, and discharge ink during the main scanning passes in which the nozzle groups comprising the first nozzle group set N51S discharge ink. The nozzle groups comprising the fourth nozzle group set N54S have the same nozzle positions in the sub-scanning direction as the nozzles comprising the second nozzle group set N52S, and discharge ink during the main scanning passes in which the nozzle groups comprising the second nozzle group set N52S discharge ink. The four nozzle groups M51, K51, C51 and Y51 belonging to the first nozzle group set N51S discharge ink in the colors of M, K, C and Y, respectively, and the four nozzle groups Y52, C52, K52 and M52 belonging to the second nozzle group set N52S discharge ink in the colors of Y, C, K and M, respectively.

This embodiment enables printing to be executed in which color unevenness is prevented using the first and second nozzle group sets, while graininess is reduced by increasing the number of ink dots in relatively light regions using the third and fourth nozzle group sets. The types of ink that can be used in the third and fourth nozzle group sets can be freely determined in consideration of the desired image quality of the printed image and the ink characteristics. For example, by using a light black ink having a lower concentration than the black ink K, high-quality monochrome printing offering reduced graininess in light gray areas can be obtained. Similarly, in order to improve the image quality of light blue areas, a construction may be used in which only light cyan ink LC is used. The placement of the third and fourth nozzle group sets can also be freely determined. For example, the nozzle group LC54 shown in FIG. 15 may be placed between the nozzle groups K51 and K52. In any case, the first sequence of the nozzle groups in the first nozzle group set maintains the reverse of the second sequence of the nozzle groups of the second nozzle group set.

G. Sixth Embodiment

Figure 16:
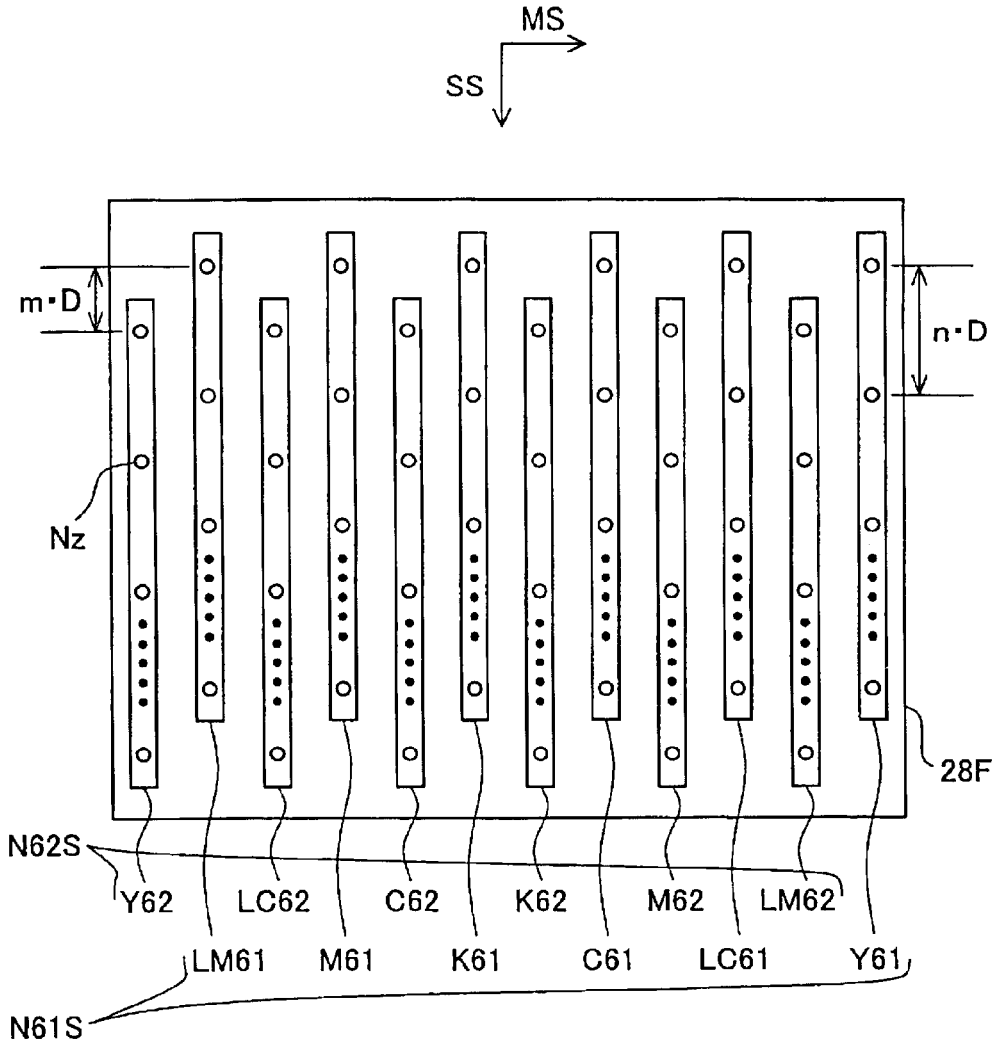
FIG. 16 is an explanatory drawing showing the nozzle arrangement on the bottom of a print head 28F of a sixth embodiment.

FIG. 16 is an explanatory drawing showing the arrangement of nozzles on the bottom of a print head 28F of a sixth embodiment. This embodiment differs from the third embodiment shown in FIG. 10 in that light cyan ink LC and light magenta ink LM are added to the ink colors that can be used by the first and second nozzle group sets. The twelve nozzle groups that discharge these six ink colors (K, C, M, LC, LM, Y) are arranged in the sequence of Y62, LM61, LC62, M61, C62, K61, K62, C61, M62, LC61, LM62, Y61 along the forward path main scanning direction. In other words, the six nozzle groups belonging to the first nozzle group set N61S are disposed in the sequence of LM61, M61, K61, C61, LC61, Y61 (the first sequence) along the forward path main scanning direction, and discharge the six ink colors of LM, M, K, C, LC and Y, respectively. Conversely, the six nozzle groups belonging to the second nozzle group set N62S are disposed in the reverse sequence of Y62, LC62, C62, K62, M62, LM62 (the second sequence) along the forward path main scanning direction, and discharge the six ink colors of Y, LC, C, K, M and LM, respectively.

In this embodiment, high-quality printing offering reduced graininess in relatively light areas can be performed using the light cyan ink LC and the light magenta ink LM. Furthermore, because all ink colors are available to the first and second nozzle group sets having mutually opposite ink discharge sequences, high-quality bidirectional printing with minimal color unevenness can be executed. Furthermore, because the various nozzle groups are arranged in order of ink visibility, i.e., in the sequence of K, C, M, LC, LM and Y, from the inner nozzle groups to the outer nozzle groups, the effect of ink dot position misalignment on image quality can be minimized.

In this embodiment, the nozzle groups belonging to the first nozzle group set N61S and the second nozzle group set N62S are arranged in an alternating fashion, but these nozzle groups may be arranged in any desired fashion so long as the nozzle group sequences within each nozzle group set (i.e., the first sequence and the second sequence) are the opposite of each other. For example, the sequence of Y62, LM62, LC62, M62, C62, K62, K61, C61, M61, LC61, LM61, Y61 in the direction of forward path main scanning may be adopted. Because the nozzle groups are arranged in the order of discharged ink visibility from the inner nozzle groups to the outer nozzle groups (K, C, M, LC, LM, Y) in this case as well, the effect of ink dot position misalignment on image quality can be minimized.

H. Variations

The present invention is not limited to the examples and embodiments described above. It may be implemented in various forms within the essential scope thereof, and the following variations are possible, for example.

H1. Variation 1

In the above embodiments, the print head unit 60 is constructed such that separate ink cartridges for the various colors of ink can be mounted thereto, but a construction in which an ink cartridge having multiple ink tanks can be mounted to the print head 60 may also be used. For example, a construction in which printing is executed by housing all ink tanks in a single ink cartridge and mounting the ink cartridge in an appropriate fashion may be adopted. Such a construction allows easy mounting of a desired ink cartridge. In general, it is acceptable if the ink cartridge mounting unit used in the present invention permits mounting of multiple ink tanks that respectively house the various different colors of ink.

As can be understood from this description, in this Specification, the term 'ink tank' refers to a container that houses a single type of ink, while the term 'ink cartridge' refers to an integrally formed container that houses at least one ink tank.

H2. Variation 2

In each of the above embodiments, the colors of inks that can be used in the first and second nozzle groups included the four ink colors of K, C, M and Y, but the possible ink colors may be freely chosen in consideration of the desired image quality of the printed image and other factors. For example, a construction that uses black ink and blue ink would enable monotone bidirectional printing that expresses gradation in bluish-gray tones. It is also preferred in this case, from the standpoint of improved image quality, that the center two nozzle groups discharge black ink K, which has relatively high visibility.

H3. Variation 3

In each of the above embodiments, the nozzles belonging to the nozzle groups of a given nozzle group set are arranged such that they are aligned with one another in the sub-scanning direction, but it is also acceptable if the positions of the nozzles of the various nozzle groups in the sub-scanning direction are offset from the nozzles of other nozzle groups in that nozzle group set. In this case as well, high-speed bidirectional printing can be executed by using the nozzle groups of the first and second nozzle group sets during both forward path main scanning and reverse path main scanning. Furthermore, color unevenness can be reduced by executing printing such that the multiple types of pixels for which ink is discharged in different ink discharge sequences are repeated in a cyclical fashion. In particular, color unevenness can be rendered less conspicuous by executing printing such that the maximum length of regions containing successive same-type pixels in either the main scanning direction, the sub-scanning direction, or both, is small. Where black ink is one of the ink colors that can be used, positional misalignment of black ink dots can be minimized through a construction wherein black ink is discharged from the center nozzles. Consequently, the image quality of monochrome text printing, which is frequently performed, can be improved. Where yellow ink is one of the ink colors that can be used, ink dot position misalignment, which increases for pixels recorded using the outermost nozzles, can be rendered less conspicuous by placing the yellow ink nozzles in the outermost nozzle groups of the print head.

H4. Variation 4

In each of the above embodiments, all nozzle groups had a uniform width in the sub-scanning direction, but it is acceptable if the nozzle groups have different widths. Such a construction will enable the execution of various different printing modes having different characteristics. For example, a construction may be used in which the nozzle group that discharges black ink K is larger in width than the other nozzle groups, such that there are more black ink nozzles than the other types of nozzles. Where monochrome printing using only black ink K is to be executed, such a construction will permit the execution of high-speed monochrome printing using all of the nozzles devoted to the discharge of black ink K. Where color printing is to be executed, the first type of high-speed bidirectional printing can be executed by using the nozzle groups in the first and second nozzle group sets for both forward path and reverse path main scanning.

H5. Variation 5

In each of the above embodiments, printing is executed using a lookup table, but the present invention can also be applied in a printing method and printing apparatus that do not use a lookup table.

H6. Variation 6

The present invention may also be applied in a drum-type printer. This type of printing apparatus is sometimes used in a facsimile device or a copying machine. In a drum-type printer, the drum rotation direction is equivalent to the main scanning direction, while the carriage movement direction is equivalent to the sub-scanning direction. This invention can be applied not only in an inkjet printer, but more generally in a dot recording apparatus that records images onto the surface of a printing medium using a recording head having multiple rows of nozzles.

H7. Variation 7

In each of the above embodiments, it is acceptable if some of the functions realized via hardware are realized through software instead, or conversely, if some of the functions realized through software are realized through hardware. For example, some or all of the functions of the printer driver 96 shown in FIG. 1 may be executed by the control circuit 40 in the printer 20. In this case, some or all of the functions of the computer 90, which functions as a print control apparatus that creates print data, are realized by the control circuit 40 of the printer 20.

H8. Variation 8

Where some or all of the functions of the present invention are realized through software (i.e., a computer program), such program may be provided in the form of a program stored on a computer-readable printing medium. For purposes of the present invention, the term 'computer-readable printing medium' is not limited to a portable printing medium such as a flexible disk or a CD-ROM, but also includes a storage device built into a computer, such as a RAM or a ROM, as well as an external storage device connected to the computer, such as a hard disk.

H9. Variation 9

In each of the above embodiments, the ink cartridge mounting section is integrally formed with the print head, but a construction may be adopted in which the print head is connected to the ink cartridge mounting section via ink supply channels, such that the print head can move independently of the ink cartridge mounting section. In such a construction, the ink cartridge mounting section can be disposed at any desired position independently of the print head. For example, ink cartridge mounting can be made easy through a construction in which the area used for mounting of the ink cartridge or cartridges is disposed on the outside of the printing apparatus. The ink supply channels are formed from a flexible tube made of rubber or silicone that is sufficiently long to permit movement of the print head within its movement range.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing apparatus that includes a print head having multiple nozzle groups each composed of multiple nozzles that discharge identical ink, and that prints images by carrying out main scanning in which the print head is moved relative to a print medium and sub-scanning in which the print head is moved relative to the print medium in a direction perpendicular to a direction of the main scanning, wherein the print head includes first and second nozzle group sets each including multiple nozzle groups that discharge multiple colors of ink including black ink;

the multiple nozzle groups in the first nozzle group set are arranged in a first sequence along the direction of main scanning, and at least part of the multiple nozzles constituting each nozzle group are disposed at identical positions in the sub-scanning direction, the multiple nozzle groups in the second nozzle group set are arranged in a second sequence along the direction of main scanning that is the reverse of the first sequence, and at least part of the multiple nozzles constituting each nozzle group are disposed at identical positions in the sub-scanning direction; and the printing apparatus can execute a first type of bidirectional printing in which the nozzle groups in the first nozzle group set and the second nozzle group set are used during both forward path and reverse path main scanning.

2. The printing apparatus according to claim 1, wherein during the first type of bidirectional printing, printing is executed such that (a) pixels recorded during forward path main scanning by the first nozzle group set and pixels recorded during reverse path main scanning by the second nozzle group set constitute a first type of pixels regarding which a discharge sequence for the multiple colors of ink is a prescribed first discharge sequence, (b) pixels recorded during reverse path main scanning by the first nozzle group set and pixels recorded during forward path main scanning by the second nozzle group set constitute a second type of pixels regarding which a discharge sequence for the multiple colors of ink is a prescribed second discharge sequence that is the reverse of the first discharge sequence, and (c) the printing apparatus executes printing such that succession of the first type pixels and that of the second type pixels are at most two pixels in at least one of the main scanning direction and the sub-scanning direction.

3. The printing apparatus according to claim 1, wherein the multiple colors of ink include ink of the four basic colors of black, cyan, magenta and yellow.

4. The printing apparatus according to claim 3, wherein the print head further includes third and fourth nozzle group sets each includes at least one nozzle group for discharging ink having a hue that is essentially same with one of the basic ink colors but having a low concentration;

the third nozzle group set discharges ink during main scanning passes during which the nozzle groups of the first nozzle group set discharge ink; and the fourth nozzle group set discharges ink during main scanning passes during which the nozzle groups of the second nozzle group set discharge ink.

5. The printing apparatus according to claim 1, wherein the multiple nozzle groups constituting the first and second nozzle group sets are respectively disposed in a prescribed sequence along the main scanning direction, and the multiple nozzle groups are arranged such that the visibility of the ink discharged from the respective nozzle groups decreases from the inner nozzle group to the outer nozzle group.

6. The printing apparatus according to claim 1, wherein the multiple nozzle groups constituting the first and second nozzle group sets are respectively disposed in a prescribed sequence along the main scanning direction, and the two nozzle groups in the center of the multiple nozzle groups are nozzle groups that discharge the black ink.

7. The printing apparatus according to claim 1, wherein the multiple colors of ink include yellow ink;

the multiple nozzle groups constituting the first and second nozzle group sets are respectively disposed in a prescribed sequence along the main scanning direction, and the two nozzle groups farthest to the outside among the multiple nozzle groups are nozzle groups that discharge the yellow ink.

8. The printing apparatus according to claim 1, wherein the multiple nozzles constituting the first nozzle group set and the multiple nozzles constituting the second nozzle group set are disposed at different positions along the sub-scanning direction.

9. The printing apparatus according to claim 8, wherein the apparatus executes overlap printing during the first type of bidirectional printing, whereby recording is performed for intermittent pixel positions on each raster line during one main scanning pass, and recording is completed for all pixel positions on each raster line through multiple main scanning passes.

10. The printing apparatus according to claim 8, wherein the multiple nozzles constituting the nozzle groups are disposed such that a nozzle pitch along the sub-scanning direction equals $2k \cdot D$ where k is an odd number and D is a dot pitch corresponding to a print resolution in the sub-scanning direction, and the multiple nozzle groups in the first nozzle group set and the multiple nozzle groups in the second nozzle group set are disposed such that the positions of the nozzles thereof along the sub-scanning direction are offset by the distance $k \cdot D$, and wherein the apparatus executes printing such that during the first type of bidirectional printing, the first type of pixels and the second type of pixels appear in a cyclical fashion along the sub-scanning direction through selection and use of an odd number of nozzles from among the multiple nozzles constituting the first nozzle group set and the second nozzle group set.

11. The printing apparatus according to claim 1, wherein the multiple nozzle groups have a same width in the sub-scanning direction.

12. A printing apparatus that includes a print head having multiple nozzle groups each composed of multiple nozzles that discharge identical ink, and that prints images by carrying out main scanning in which the print head is moved relative to a print medium and sub-scanning in which the print head is moved relative to the print medium in a direction perpendicular to a direction of the main scanning, wherein the print head includes first and second nozzle group sets each including multiple nozzle groups that discharge multiple colors of ink including black ink and yellow ink;

the multiple nozzle groups in the first nozzle group set are arranged in a first sequence along the direction of main scanning;

the multiple nozzle groups in the second nozzle group set are arranged in a second sequence along the direction of main scanning that is the reverse of the first sequence;

the multiple nozzle groups constituting the first and second nozzle group sets are respectively disposed in a prescribed sequence along the main scanning direction, two nozzle groups in the center of the multiple nozzle groups discharge the black ink, and two nozzle groups farthest to the outside among the multiple nozzle groups discharge the yellow ink; and the printing apparatus can execute a first type of bidirectional printing in which the nozzle groups in the first nozzle group set and the second nozzle group set are used during both forward path and reverse path main scanning.

13. A print control apparatus that generates print data to be supplied to a printing unit that includes a print head having multiple nozzle groups each composed of multiple nozzles that discharge identical ink, and that executes printing of images by (i) carrying out main scanning in which the print head and a print medium are moved relative to each other, as well as sub-scanning in which the print head and the print medium are moved relative to each other in a direction perpendicular to a direction of the main scanning, and (ii) discharging ink onto the print medium from nozzles during main scanning, wherein the print head of the printing unit includes first and second nozzle group sets each including multiple nozzle groups that discharge multiple colors of ink including black ink;

the multiple nozzle groups in the first nozzle group set are arranged in a first sequence along the direction of main scanning, and at least part of the multiple nozzles constituting each nozzle group are disposed at identical positions in the sub-scanning direction;

the multiple nozzle groups in the second nozzle group set are arranged in a second sequence along the direction of main scanning that is the reverse of the first sequence, and at least part of the multiple nozzles constituting each nozzle group are disposed at identical positions in the sub-scanning direction;

the printing unit can execute a first type of bidirectional printing in which the nozzle groups in the first nozzle group set and the second nozzle group set are used during both forward path and reverse path main scanning; and the print control apparatus includes a print data generator that generates print data used when the printing unit is caused to execute the first type of bidirectional printing, wherein the print data constitutes data that causes the printing unit to execute the first type of bidirectional printing such that (a) pixels recorded during forward path main scanning by the first nozzle group set and pixels recorded during reverse path main scanning by the second nozzle group set constitute a first type of pixels regarding which a discharge sequence for the multiple colors of ink is a prescribed first discharge sequence;

(b) pixels recorded during reverse path main scanning by the first nozzle group set and pixels recorded during forward path main scanning by the second nozzle group set constitute a second type of pixels regarding which a discharge sequence for the multiple colors of ink constitutes a prescribed second discharge sequence that is the reverse of the first discharge sequence; and (c) the printing unit executes the first type of bidirectional printing such that succession of the first type pixels and that of the second type pixels are at most two pixels in at least one of the main scanning direction and the sub-scanning direction.

14. A method of printing using a printing apparatus that prints images by carrying out main scanning in which a print head is moved relative to a print medium and sub-scanning in which the print head is moved relative to the print medium in a direction perpendicular to a direction of the main scanning, and discharging ink onto the print medium from nozzles during main scanning, the method comprising the steps of:

providing a print head having multiple nozzle groups each including multiple nozzles that discharge identical ink; and executing printing using the print head, wherein the print head includes first and second nozzle group sets each including multiple nozzle groups that discharge multiple colors of ink including black ink;

the multiple nozzle groups in the first nozzle group set are arranged in a first sequence along the direction of main scanning, and at least part of the multiple nozzles constituting each nozzle group are disposed at identical positions in the sub-scanning direction;

the multiple nozzle groups in the second nozzle group set are arranged in a second sequence along the direction of main scanning that is the reverse of the first sequence, and at least part of the multiple nozzles constituting each nozzle group are disposed at identical positions in the sub-scanning direction; and the printing step includes the step of executing a first type of bidirectional printing in which the nozzle groups in the first nozzle group set and the second nozzle group set are used during both forward path and reverse path main scanning.

15. The printing method according to claim 14, wherein the printing step includes a step of generating print data such that (a) pixels recorded during forward path main scanning by the first nozzle group set and pixels recorded during reverse path main scanning by the second nozzle group set constitute a first type of pixels regarding which a discharge sequence for the multiple colors of ink is a prescribed first discharge sequence, (b) pixels recorded during reverse path main scanning by the first nozzle group set and pixels recorded during forward path main scanning by the second nozzle group set constitute a second type of pixels regarding which a discharge sequence for the multiple colors of ink is a prescribed second discharge sequence that is the reverse of the first discharge sequence, and (c) succession of the first type pixels and that of the second type pixels are at most two pixels in at least one of the main scanning direction and the sub-scanning direction.

16. The printing method according to claim 14, wherein the multiple colors of ink include ink of the four basic colors of black, cyan, magenta and yellow.

17. The printing method according to claim 16, wherein the print head further includes third and fourth nozzle group sets each includes at least one nozzle group for discharging ink having a hue that is essentially same with one of the basic ink colors but having a low concentration;

the third nozzle group set discharges ink during main scanning passes during which the nozzle groups of the first nozzle group set discharge ink; and the fourth nozzle group set discharges ink during main scanning passes during which the nozzle groups of the second nozzle group set discharge ink.

18. The printing method according to claim 14, wherein the multiple nozzle groups constituting the first and second nozzle group sets are respectively disposed in a prescribed sequence along the main scanning direction, and the multiple nozzle groups are arranged such that the visibility of the ink discharged from the respective nozzle groups decreases from the inner nozzle group to the outer nozzle group.

19. The printing method according to claim 14, wherein the multiple nozzle groups constituting the first and second nozzle group sets are respectively disposed in a prescribed sequence along the main scanning direction, and the two nozzle groups in the center of the multiple nozzle groups are nozzle groups that discharge the black ink.

20. The printing method according to claim 14, wherein the multiple colors of ink include yellow ink;

the multiple nozzle groups constituting the first and second nozzle group sets are respectively disposed in a prescribed sequence along the main scanning direction, and the two nozzle groups farthest to the outside among the multiple nozzle groups are nozzle groups that discharge the yellow ink.

21. The printing method according to claim 14, wherein the multiple nozzles constituting the first nozzle group set and the multiple nozzles constituting the second nozzle group set are disposed at different positions along the sub-scanning direction.

22. The printing method according to claim 21, wherein the first type of bidirectional printing step includes a step of executing overlap printing whereby recording is performed for intermittent pixel positions on each raster line during one main scanning pass, and recording is completed for all pixel positions on each raster line through multiple main scanning passes.

23. The printing method according to claim 22, wherein the multiple nozzles constituting the nozzle groups are disposed such that a nozzle pitch along the sub-scanning direction equals 2k·D where k is an odd number and D is a dot pitch corresponding to a print resolution in the sub-scanning direction, and the multiple nozzle groups in the first nozzle group set and the multiple nozzle groups in the second nozzle group set are disposed such that the positions of the nozzles thereof along the sub-scanning direction are offset by the distance k·D, and wherein the first type of bidirectional printing step includes a step of executing printing such that the first type of pixels and the second type of pixels appear in a cyclical fashion along the sub-scanning direction through selection and use of an odd number of nozzles from among the multiple nozzles constituting the first nozzle group set and the second nozzle group set.

24. The printing method according to claim 14, wherein the multiple nozzle groups have a same width in the sub-scanning direction.

25. A computer program product for causing a computer to generate print data to be supplied to a printing unit that includes a print head having multiple nozzle groups each including multiple nozzles that discharge identical ink, and that executes printing of images by carrying out main scanning in which the print head and a print medium are moved relative to each other, as well as sub-scanning in which the print head and the print medium are moved relative to each other in a direction perpendicular to a direction of the main scanning, and discharging ink onto the print medium from nozzles during main scanning, the computer program product comprising:

a computer readable medium; and a computer program stored on the computer readable medium;

wherein the print head of the printing unit includes first and second nozzle group sets each including multiple nozzle groups that discharge multiple colors of ink including black ink;

the multiple nozzle groups in the first nozzle group set are arranged in a first sequence along the direction of main scanning, and at least part of the multiple nozzles constituting each nozzle group are disposed at identical positions in the sub-scanning direction;

the multiple nozzle groups in the second nozzle group set are arranged in a second sequence along the direction of main scanning that is the reverse of the first sequence, and at least part of the multiple nozzles constituting each nozzle group are disposed at identical positions in the sub-scanning direction;

the printing unit can execute a first type of bidirectional printing in which the nozzle groups in the first nozzle group set and the second nozzle group set are used during both forward path and reverse path main scanning; and the computer program causes the computer to perform the function of generating print data such that (a) pixels recorded during forward path main scanning by the first nozzle group set and pixels recorded during reverse path main scanning by the second nozzle group set constitute a first type of pixels regarding which a discharge sequence for the multiple colors of ink is a prescribed first discharge sequence, (b) pixels recorded during reverse path main scanning by the first nozzle group set and pixels recorded during forward path main scanning by the second nozzle group set constitute a second type of pixels regarding which a discharge sequence for the multiple colors of ink is a prescribed second discharge sequence that is the reverse of the first discharge sequence, and (c) succession of the first type pixels and that of the second type pixels are at most two pixels in at least one of the main scanning direction and the sub-scanning direction.

* * * * *